US007537177B2

(12) United States Patent
Horiguchi et al.

(10) Patent No.: US 7,537,177 B2
(45) Date of Patent: May 26, 2009

(54) LEVEL WOUND COIL, METHOD OF MANUFACTURING SAME, AND PACKAGE FOR SAME

(75) Inventors: Ken Horiguchi, Tsuchiura (JP); Yusuke Takenaga, Inashiki-gun (JP); Katsumi Nomura, Tsuchiura (JP); Mamoru Hofuku, Inashiki-gun (JP); Kenichi Inui, Tsuchiura (JP); Tomo Kawano, Ishioka (JP)

(73) Assignee: Hitachi Cable, Ltd., Tokyo (JP)

( * ) Notice: Subject to any disclaimer, the term of this patent is extended or adjusted under 35 U.S.C. 154(b) by 263 days.

(21) Appl. No.: 11/372,340

(22) Filed: Mar. 10, 2006

(65) Prior Publication Data

US 2006/0208121 A1 Sep. 21, 2006

(30) Foreign Application Priority Data

Mar. 11, 2005 (JP) ..... 2005-069932
Dec. 20, 2005 (JP) ..... 2005-367280

(51) Int. Cl.
*B65H 55/04* (2006.01)

(52) U.S. Cl. ..... 242/174; 242/476.7

(58) Field of Classification Search ..... 242/174–178, 242/476.7, 478.1, 484, 484.1, 484.4
See application file for complete search history.

(56) References Cited

U.S. PATENT DOCUMENTS 5,193,761 A * 3/1993 Fritz et al. ..... 242/159

FOREIGN PATENT DOCUMENTS

JP 2002-370869 A 12/2002

* cited by examiner

*Primary Examiner*—Peter M Cuomo
*Assistant Examiner*—William E Dondero
(74) *Attorney, Agent, or Firm*—Foley & Lardner LLP

(57) ABSTRACT

A level wound coil (LWC) having a plurality of coil layers each of which has a pipe wound in alignment winding and in traverse winding. The LWC has a shift section where the pipe is shifted from the m-th coil layer to the (m+1)-th coil layer on a bottom surface thereof when the LWC is disposed on a mount surface. The shift section has the k-th shift section on inner layer side and the (k+1)-th shift section on outer layer side, where a start point of the (k+1)-th shift section does not transit, relative to a start point of the k-th shift section, to a winding direction of the pipe.

3 Claims, 22 Drawing Sheets

LEVEL WOUND COIL, METHOD OF MANUFACTURING SAME, AND PACKAGE FOR SAME

The present application is based on Japanese patent application Nos. 2005-69932 and 2005-367280.filed Mar. 11, 2005 and Dec. 20, 2005, respectively, the entire contents of which are incorporated herein by reference.

BACKGROUND OF THE INVENTION

1. Field of the Invention

This invention relates to a level wound coil (hereinafter called LWC) and, particularly, to an LWC that is formed winding a metal pipe, such as a copper and copper alloy pipe, which is used as a heat transfer pipe of an air-conditioning heat exchanger, a water pipe etc. Furthermore, this invention relates to a method of manufacturing the LWC and a package for the LWC.

2. Description of the Related Art

A heat transfer pipe such as an inner grooved tube/pipe and a smooth (plain) tube/pipe is used for the air-conditioning heat exchanger, the water pipe etc. The heat transfer pipe is typically formed of a copper or copper alloy pipe (hereinafter simply called copper pipe). In the manufacturing process thereof, the pipe is coiled and then annealed into a given tempered material. Then, it is stored or transported in the form of LWC. In use, the LWC is uncoiled and cut into a pipe with a desired length.

When the LWC is used, the copper pipe is fed out from the LWC by using a copper pipe feeding apparatus (uncoiler). For example, JP-A-2002-370869 discloses a copper pipe feeding apparatus, which will be explained below.

FIG. 17A is a perspective view showing a conventional copper pipe feeding apparatus (vertical uncoiler) FIG. 17B is a perspective view showing a conventional copper pipe feeding apparatus (horizontal uncoiler).

As shown in FIG. 17A, the copper pipe feeding apparatus 10A is operated such that a bobbin 21 with an LWC 20 coiled around there is vertically attached, and a copper pipe 22 is fed from the bobbin 21 while being guided by a guide 11 in a feeding direction. Then, it is cut into a pipe with a desired length by a cutter (not shown).

As shown in FIG. 17B, the copper pipe feeding apparatus 10B is operated such that the bobbin 21 with the LWC 20 coiled around there is horizontally disposed on a turntable 12, and the copper pipe 22 is fed from the bobbin 21 while being guided by a guide 13 in a feeding direction. Then, it is cut into a pipe with a desired length by a cutter (not shown).

FIG. 18 is a cross sectional view showing a detailed arrangement of LWC coiled around the bobbin in FIG. 17A or 17B. As shown, the LWC 20 is structured with the copper pipe coiled around the bobbin 21. The bobbin 21 comprises an inner cylinder 23 around which the copper pipe 22 is coiled in multiple layers, and a pair of disk-like side boards 24 attached to both sides of the inner cylinder 23.

However, the copper pipe feeding apparatuses 10A, 10B as shown in FIGS. 17A and 17B have a problem that the structure is complicated and the cost thereof increases.

In order to solve this problem, JP-A-2002-370869 discloses a copper pipe feeding method called "Eye to the sky" (hereinafter called ETTS).

FIG. 19 is a perspective view showing the method of feeding a copper pipe by the ETTS method. An LWC assembly 30 has plural LWC's 32 that are stacked through a cushioning material 33 such that its center axis is directed perpendicularly to the upper surface of a pallet 31. The, pallet 31 is usually formed rectangular and comprises plural wooden square logs 31*a* and one or more wooden board 31*b* attached on the square logs 31*a*. The cushioning material 33 is formed of wood, paper or plastics and has a disk shape with a greater diameter than the LWC 32.

As shown, the LWC 32 has an outside diameter of about 1000 mm and an inside diameter of 500 to 600 mm. The total height of the LWC assembly 30 including the pallet 31 is about 1 to 2 m.

The method of feeding a copper pipe by the ETTS method will be explained below referring to FIG. 19.

The copper pipe 35 is fed upward from the inside of the top LWC 32 in the LWC assembly 30. Then, in order to cut the copper pipe 35 on a pass line set horizontally about 1 m over the floor, the feeding direction is changed by a guide 34 disposed above the LWC assembly 30. Then, the copper pipe 35 is cut into a desired length by a cutter. A circular arc as the guide 34 is formed from a metal or plastic tube and has an inner diameter larger than an outer diameter of the copper pipe 35. The height from the plane on which to place the pallet 31 to the guide 34 is about 2.5 to 3.5 m.

The ETTS method is advantageous in removing the purchase cost of the bobbin since the bobbin 21 as shown in FIG. 18 is not needed. Further, as shown in FIG. 19, since it is not needed to rotate the LWC, the uncoiler and turntable as shown in FIGS. 17A and 17B are not needed. Thus, the facility cost can be significantly reduced.

A method of coiling the LWC 32 will be explained below referring to FIG. 18.

As shown in FIG. 18, for example, the copper pipe 22 is wound on the inner cylinder 23 of the bobbin 21 from a copper pipe 22*a* at start position to the right direction in alignment winding. The alignment winding is a method that the copper pipe 22 is wound in a circuit around the inner cylinder 23 and then it is wound in the next circuit in close contact with the previous circuit not to have a gap therebetween.

After the copper pipe 22 is wound up to the right end to have a cylinder form as the first layer, the second layer is wound on the first layer in alignment winding along the center-axis direction of the LWC from the right end to the left end (in the reverse direction). At that time the copper pipe of the second layer is arrayed in close-packed alignment to that of the first layer. Further, the third layer coil is formed on the second layer coil in the same way. This is called traverse winding, where after the first-layer cylindrical coil is formed, the second-layer cylindrical coil is wound in the reverse direction along the center-axis direction of the LWC. Thereby, the LWC can be reduced in volume and, therefore, a space needed in storing and transporting can be reduced.

FIG. 20 is a schematic cross sectional view illustrating an uncoiling method in LWC. FIG. 20 indicates the uncoiling state when the LWC 20 is uncoiled by the ETTS method, where the LWC 20 is produced such that the copper pipe 22 is wound around the bobbin 21 by the coiling method as shown in FIG. 18, removing the bobbin 21, disposing the LWC 20 on the cushioning material 33 as shown in FIG. 19. At first, the copper pipe 22*a* at start position on the inner layer side is fed upward. After the feeding of the first-layer is completed, the feeding of the second layer begins from a copper pipe 22*b* at lower end. Subsequently, the third layer adjoined outside of the second layer is fed from the upper end to the lower end.

However, the uncoiling method in LWC as shown in FIG. 20 has the next problems. When the LWC 20 is set as the LWC 32 in FIG. 19, the copper pipe 22*b* at lower end of the second layer is sandwiched between the cushioning material 33 (or the pallet 31) and a copper pipe 22 lying directly thereon. Therefore, it may be difficult to feed the copper pipe 22*b* due to the friction. When the friction in feeding is increased, the copper pipe 22 may be subjected to a bend or kink, resulting in product failure. Further, copper pipes 22*b* at the lower end of even-numbered layers, i.e., the second and fourth layers etc. can have the same problem.

In this regard, JP-A-2002-370869 discloses an uncoiling method to facilitate the feeding of a copper pipe at lower end in the ETTS method.

FIGS. 21 and 22 (corresponding to FIGS. 3 and 7, respectively, of JP-A-2002-370869) are schematic cross sectional views illustrating the uncoiling method to facilitate the feeding of a copper pipe at lower end.

One-side section of LWC 40 as shown in FIG. 21 is structured such that a copper pipe 41*a* at start position is located on the top, where an odd-numbered layer has n pipes (circuits) and an even-numbered layer has (n−1) pipes (circuits). The n is a natural number of 2 or more, typically 10 or more, and the pipes are wound in alignment winding.

In LWC 40 as shown in FIG. 21, the copper pipe 41*a* at start position on the inner layer side is fed upward. After the feeding of the first-layer is completed, the feeding of the second layer begins from a copper pipe 41*b* at lower end. In this case, since a gap exists between the copper pipe 41*b* at lower end of the second layer and the cushioning material 33 or pallet 31, the copper pipe 41*b* is less likely to be subjected to the resistance of the friction. Thus, the copper pipe 41 can be fed stably.

In contrast, FIG. 21 shows one-side section of LWC 40 that a copper pipe 41*a* at start position is located at the bottom close to the cushioning material 33. The copper pipe 41*a* at start position on the inner layer side is fed upward from the lower end to the upper end. After the feeding of the first layer is completed, the feeding of the second layer begins from a copper pipe 41 at the upper end. In this case, since a copper pipe 41 at lower end of the second layer is not sandwiched when the copper pipe 41 turns upward, the copper pipe 41 can be fed stably as well as the case in FIG. 21.

Meanwhile, the above is taught in paragraphs [0009] to [0012], [0014] to [0017], [0039], [0042], [0062], and [0063] and FIGS. 3, 7 and 14 of JP-A-2002-370869.

However, the uncoiling method of JP-A-2002-370869 has the next problem. In the LWC wound as shown in FIG. 21, a circuit from the copper pipe 41 at lower end of the first layer to the copper pipe 41*b* at lower end of the second layer is exactly formed of a continuous copper pipe, though seen as separate pipes in the cross sectional view of FIG. 21. Thus, the copper pipe 41 is continuously shifted upward in a shift section on the circuit. When the length of the shift section increases, the gap between the copper pipe 41*b* at lower end of the second layer and the cushioning material 33 or pallet 31 may substantially disappear. Namely, the copper pipe 41*b* at lower end of the second layer may be sandwiched between the cushioning material 33 or the pallet 31 and the copper pipe 41 lying directly thereon. Therefore, it may be difficult to feed the copper pipe 41 and the copper pipe 41 may be subjected to a bend or kink.

The shift section that the copper pipe is shifted to the next-layer (i.e., the outer layer) will be detailed below referring to FIGS. 23A and 23B.

FIG. 23A is a schematic cross sectional view illustrating a portion without the shift section in LWC, and FIG. 23B is a schematic cross sectional view illustrating a portion with the shift section in LWC. In FIGS. 23A and 23B, an arrow passing through each pipe means that the LWC is uncoiled along the arrow direction. In the portion without the shift section as shown in FIG. 23A, of neighboring two layers, the outer layer has n−1 or n+1 stacked pipes when the inner layer has n stacked pipes. However, in the portion with the shift section 3 as shown in FIG. 23B, the outer layer also has n stacked pipes. Furthermore, with respect to the arrangement (positional relationship) of the neighboring layers of the copper pipe 2, a stack column (herein, a stack column means a column of the stacked copper pipes in a vertical section when LWC is vertically cut along a radius of LWC) in the portion without the shift section is arranged being fitted into a concave part formed in at least one of the neighboring stack columns (on the inner and outer sides). In contrast, a stack column (e.g., the fourth layer in FIG. 23B) in the portion with the shift section is arranged contacting a convex part formed in the neighboring stack columns. When the copper pipe 2 is fed as shown in FIG. 23B, the fourth-layer copper pipe at lower end of the shift section 3 may be sandwiched between a copper pipe lying directly thereon and the cushioning material (or coil spacer) lying under the LWC. As a result, the copper pipe will be trapped by them.

SUMMARY OF THE INVENTION

It is an object of the invention to provide an LWC that can avoid the pipe trapping at the shift section when feeding a copper pipe from the LWC by using the ETTS method.

It is a further object of the invention to provide a method of manufacturing the LWC.

It is a further object of the invention to provide a package for the LWC.

As the results of analyzing the ETTS method by the inventors, it is found that the pipe trapping in the ETTS method is caused by the existence of the shift section and the arrangement thereof (i.e., the arrangement thereof at the bottom surface of the LWC, and the arrangement of a stack column in a vertical section at the shift section). Based on this finding, the inventors have completed the invention as described below.

(1) According to one aspect of the invention, a level wound coil (LWC) comprises:

a plurality of coil layers each of which comprises a pipe wound in alignment winding and in traverse winding, a coil of a (m+1)-th coil layer being located such that a pipe at start position thereof is fitted into a concave part formed outside of the m-th coil layer and between a pipe at a lower end and its adjacent pipe of a m-th coil layer, where, when the LWC is disposed on a mount surface perpendicular to a coil center axis of the LWC, m is an odd natural number if a start position of the winding of the LWC is located at the upper end and m is an even natural number if the start position is located at the lower end, wherein the LWC comprises a shift section where the pipe is shifted from the m-th coil layer to the (m+1)-th coil layer on a bottom surface thereof when the LWC is disposed on the mount surface, and the shift section comprises a k-th shift section on inner layer and a (k+1)-th shift section on outer layer side, where a start point of the (k+1)-th shift section does not transit, relative to a start point of the k-th shift section, to a winding direction of the pipe.

In the above invention (1), the following modifications and changes can be made.

(i) The (k+1)-th shift section transits, relative to the start point of the k-th shift section, to a direction reverse to the winding direction of the pipe.

(ii) The k-th shift section and the (k+1)-th shift section are located on a same radius on the bottom surface of the LWC.

(iii) All of the shift sections of the LWC are located in a sector region defined between a center point on the bottom surface of the LWC and a start point and an end point of a shift section in an outermost coil layer of the LWC.

(iv) The shift section transits in sequence, spirally from an inner coil layer to an outer coil layer of the LWC while having, in a circumferential direction of the LWC, substantially no gap between the start point of the k-th shift section and an end point of the (k+1)-th shift section, (v) The shift section transits in sequence, spirally from an inner coil layer to an outer coil layer of the LWC while having, in a circumferential direction of the LWC, a gap between the start point of the k-th shift section and an end point of the (k+1)-th shift section, where the circumferential direction is in the winding direction of the pipe.

(vi) The LWC comprises a vertical section without the shift section that is about one third or less of all vertical sections, where the vertical sections is defined by vertically cutting the LWC from the coil center axis along a radius.

(vii) All vertical sections comprise the shift section, where each of the vertical sections is defined by vertically cutting the LWC from the coil center axis along a radius.

(viii) The shift section is substantially on an odd coil layer with an outermost coil layer being odd-numbered when the start position of the winding is located at the upper end, and the shift section is substantially on an even coil layer with an outermost coil layer being even-numbered when the start position of the winding is located at the lower end, (ix) The: LWC comprises a first coil layer that is n or less in winding number, provided that an innermost coil layer is the first coil layer and the winding number of a second coil layer and an even-numbered layer thereafter is n.

(2) According to another aspect of the invention, a method of manufacturing the LWC as defined above in (1), comprising:

winding the pipe around a bobbin such that a location of the shift section is adjusted by shifting the pipe on the m-th coil layer to the (m+1)-th coil layer before the pipe forms a circuit in winding at a return portion of the traverse winding to define the bottom surface of the LWC.

In the above invention (2), the following modifications and changes can be made.

(x) The start point of the (k+1)-th shift section is located in the winding direction beforehand a vertical section including the coil center axis where the start point of the k-th shift section is located, or at the same position as the vertical section.

(xi) The bobbin is provided with a step portion with one end thereof in order that an end portion of an innermost coil layer is not shifted on or protruded from an end surface of the LWC.

(3) According to another aspect of the invention, a package for LWC, comprising:

a pallet comprising a mount surface; and the LWC as defined above in (1), the LWC being disposed or stacked in plurality through a cushioning material on the mount surface perpendicular to the coil center axis of the LWC.

Herein, "a start point of a shift section" means a start point of a shift section where a wound pipe is shifted from a m-th layer to a (m+1)-th layer, i.e., a point from where a pipe at lower end of the math layer starts shifting outward in the radial direction of an LWC. Further, "an end point of a shift section" means an end point of a shift section where a wound pipe is shifted from a m-th layer to a (m+1)-th layer, i.e., a point where a pipe at lower end of the (m+1) -th layer is fitted into a concave part formed outside between stacked pipes of the m-th layer.

Herein, "a winding direction of a pipe" means a winding direction defined when a pipe is wound around a bobbin etc. When the pipe is wound around there by rotating the bobbin, the winding direction is defined as the reverse direction to the rotation direction of the bobbin. Further, herein, "not transiting to a forward direction" means a state that it transits in the reverse direction or it does not transit in the forward or reverse direction.

Herein, a "shift section" is generally defined as the sum of an "axis-direction non-shift section" that a pipe is not shifted in the center-axis direction of an LWC (i.e., the axis-direction non-shift section includes (a) a part shifted only in the radial direction of an LWC, (b) a part not shifted in the radial direction nor the axis direction of the LWC) and an "axis-direction shift section" that the pipe is shifted mainly in the center-axis direction of the LWC. Of the "shift section", the "axis-direction non-shift section" is likely to be sandwiched between a pipe lying directly thereon and the coil spacer (or cushioning material) so that a kink or bend may happen thereat during the feeding of the copper pipe. Meanwhile, as described earlier, the copper pipe is shifted at least outside in the coil radial direction at the start point of the "shift section".

Herein, terms for LWC are defined as follows. Viewing from the center axis of an LWC, stacked copper pipes in a concentric fashion is called "layer". From the center (=coil center axis) toward the centrifugal direction, they are numbered first layer, second layer . . . . In a layer of LWC, the number of coil circuits is called "winding number". It is also called "step number" especially when the coil center axis is disposed in the vertical direction, e.g., when the copper pipe is fed. When the coil center axis is disposed in the vertical direction, e.g., when the copper pipe is fed, a lower surface of LWC in the vertical direction to be contacted with the coil spacer (or pallet) is called "coil lower surface (lower end)" or "coil bottom", and an upper surface of LWC in the vertical direction is called "coil upper surface (upper end)". A portion shifted from m-th layer to (m+1)-th layer is called "shift section". When the coil center axis is disposed in the vertical direction, e.g., when the copper pipe is fed, the shift sections arranged at the coil lower surface are numbered k-th, (k+1)-th, . . . (from the inner side toward the outer side), where the coil pipes at the coil upper surface are not considered.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

First to Fifth Embodiments

Construction of LWC

Figure 1:
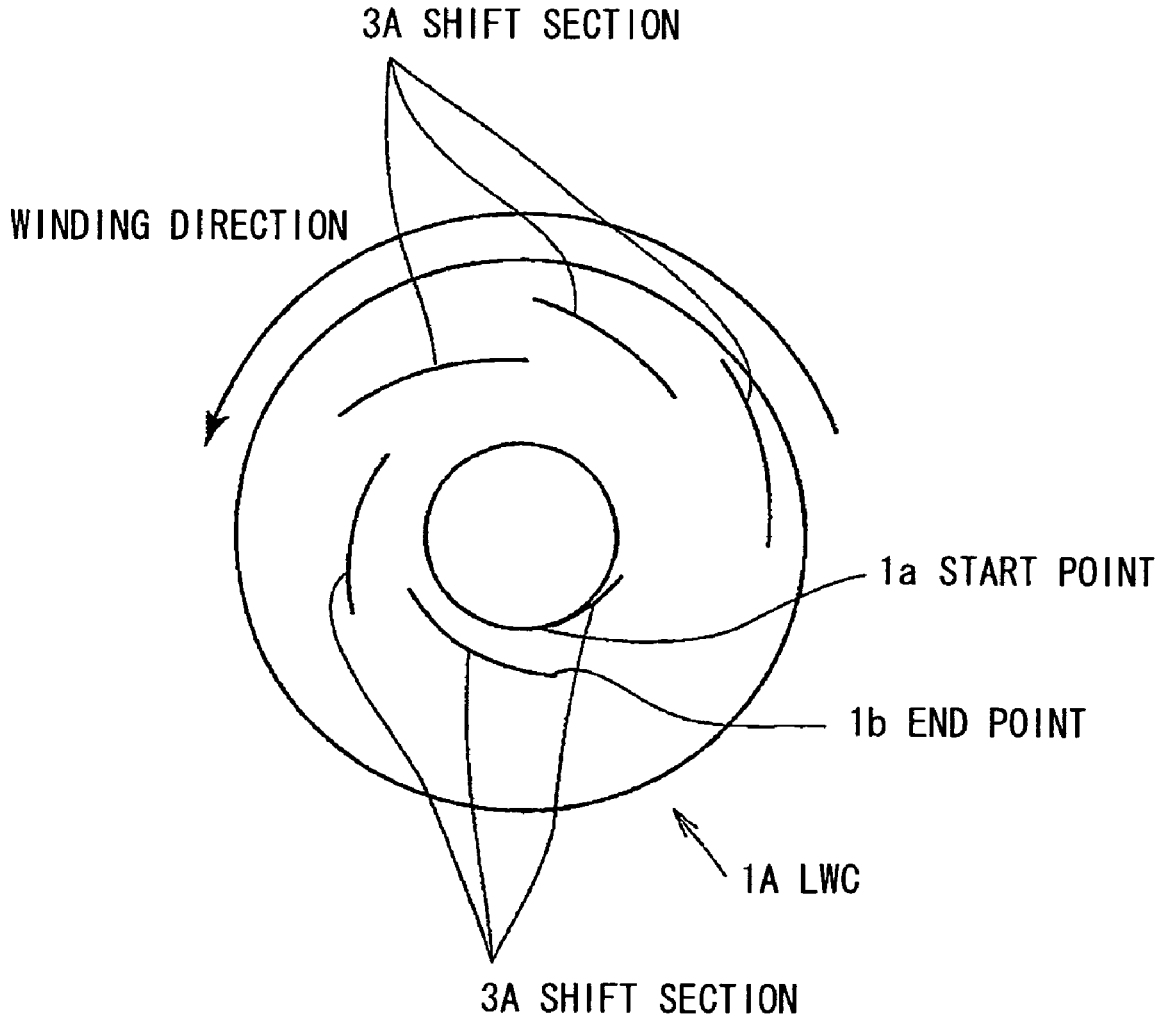
FIG. 1 is a schematic bottom view showing an LWC in a first preferred embodiment according to the invention.

FIGS. 1 to 5 are schematic bottom views showing LWC's in the first to fifth preferred embodiment according to the invention.

In FIGS. 1 to 5, in order to simplify the explanation, the shape of copper pipes is not illustrated and only the location of shift sections 3A to 3E in LWC's 1A to 1E is illustrated.

The LWC's of the embodiments are structured in the same manner as that of JP-A-2002-370869. However, they are different from the latter in location of the shift section on the coil lower surface. It is desired that the shift sections are as a whole at odd layers when the winding start position is located at the top (with the outermost layer being odd-numbered), and they are as a whole at even layers when the winding start position is located at the bottom (with the outermost layer being even-numbered).

The LWC's in JP-A-2002-370869 are structured as any of:

(a) an LWC that (i) the coil axis direction is disposed vertically with the winding start position being at the top and the coil is uncoiled from the inside, (ii) the first layer coil is formed by winding the pipe in alignment winding, subsequently the second layer coil is formed by winding the pipe in alignment winding on the first layer coil while being fitted into a concave part formed outside between stacked pipes of the first layer coil, thereafter, in like manner, plural layer coils are formed by winding the third layer coil in alignment winding on the second layer coil, the fourth layer coil in alignment winding on the third layer coil, (iii) provided that an odd-numbered layer coil thereof has a winding number of n, an even-numbered layer coil thereof has a winding number of (n−1) and (iv) the stack direction in vertical section is reversed each other between the odd-numbered layer coil and the even-numbered layer coil;

(b) an LWC that (i) the coil axis direction is disposed vertically with the winding start position being at the bottom and the coil is uncoiled from the inside, (ii) the first layer coil is formed by winding the pipe in alignment winding, subsequently the second layer coil is formed by winding the pipe in alignment winding on the first layer coil while being disposed into a concave part (or apart adjacent to there) formed outside between stacked pipes of the first layer coil, thereafter, in like manner, plural layer coils are formed by winding the third layer coil in alignment winding on the second layer coil, the fourth layer coil in alignment winding on the third layer coil, (iii) provided that an odd-numbered layer coil thereof has a winding number of n, an even-numbered layer coil thereof has a winding number of (n+1), and (iv) the stack direction in vertical section is reversed each other between the odd-numbered layer coil and the even-numbered layer coil; and (c) an LWC that (i) the coil axis direction is disposed vertically and the coil is uncoiled from the inside, (ii) the first layer coil is formed by winding the pipe in alignment winding, subsequently the second layer coil is formed by winding the pipe in alignment winding on the first layer coil while being disposed into a concave part (or outside thereof) formed outside between stacked pipes of the first layer coil such that the pipe at start position of the second layer is fitted into a concave part formed between the pipe at lower/upper end and its adjacent pipe of the first layer coil, thereafter, in like manner, plural layer coils are formed by winding the third layer coil in alignment winding on the second layer coil, the fourth layer coil in alignment winding on the third layer coil, (iii) provided that an odd-numbered layer coil thereof has a winding number of n, an even-numbered layer coil thereof has a winding number of n, and (iv) the stack direction in vertical section is reversed each other between the odd-numbered layer coil and the even-numbered layer coil.

FIGS. 1, 2, 4 and 5 (corresponding to the first, second, fourth and fifth embodiments, respectively) are schematic bottom views showing examples that a start point 1*a* of a (k+1)-th shift section (on outer-layer side) transits, in a reverse direction to the winding direction (i.e., counterclockwise) of the copper pipe, relative to a start point 1*a* of a k-th shift section (on inner-layer side). In these examples, the shift section transits in the reverse direction (i.e., clockwise) to the winding direction (i.e., counterclockwise) of the copper pipe. However, the shift section may transit in the reverse direction (i.e., counterclockwise) to the winding direction (i.e., clockwise) of the copper pipe.

FIG. 1 is a schematic bottom view showing an LWC in the first preferred embodiment according to the invention.

As shown, the LWC 1A is constructed such that a shift section 3A transits in sequence, spirally from the inner layer to the outer layer of the LWC, while having in the circumferential direction substantially no gap between the start point 1*a* of the k-th shift section (on inner-layer side) and end point 1*b* of the (k+1)-th shift section (on outer-layer side) Herein, "having in the circumferential direction substantially no gap" means that no gap is crossed with any lines scanned from the coil center to the centrifugal direction. Thus, the LWC 1A has always the shift section 3A at lower end in any vertical sections obtained when cutting vertically the LWC along the coil center axis.

Figure 2:
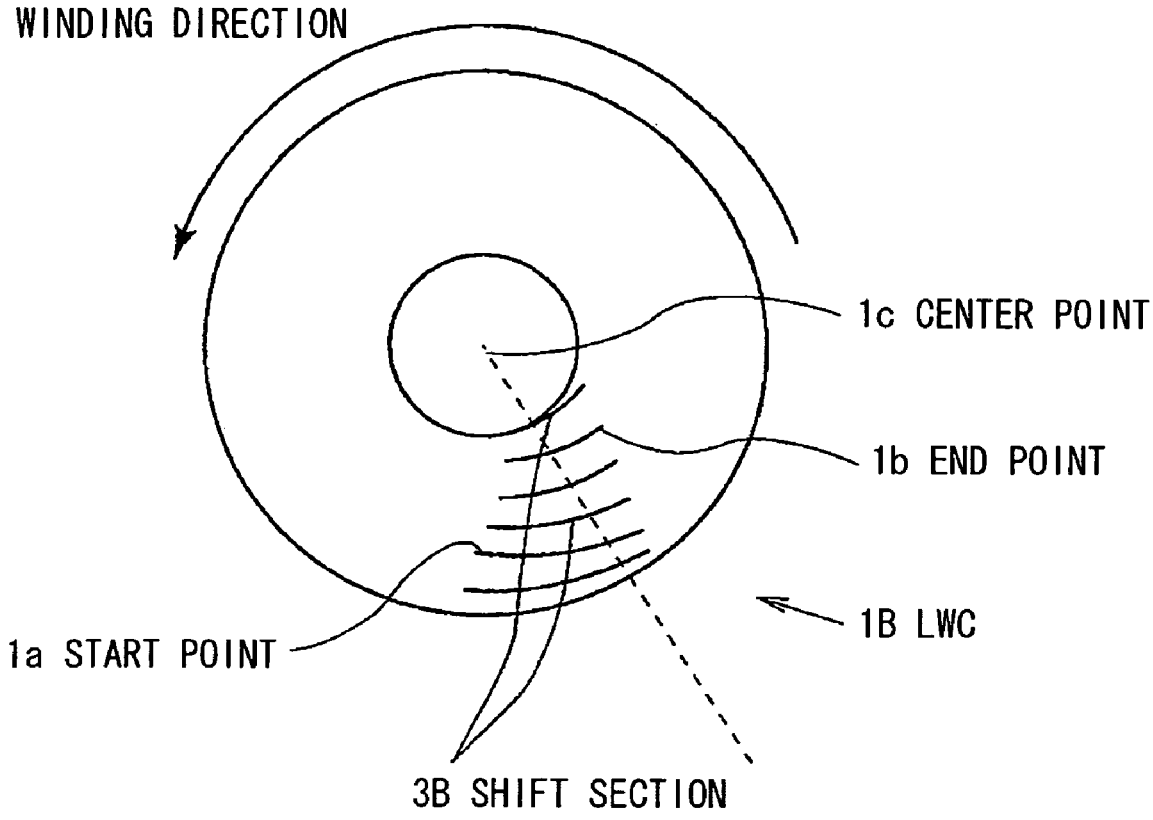
FIG. 2 is a schematic bottom view showing an LWC in a second preferred embodiment according to the invention.

FIG. 2 is a schematic bottom view showing an LWC in the second preferred embodiment according to the invention.

As shown, the LWC 1B is constructed such that a k-th shift section 3B (on inner-layer side) and a (k+1)-th shift section 3B (on outer-layer side) transit lying on a same radius on the bottom surface of the LWC.

Figure 4:
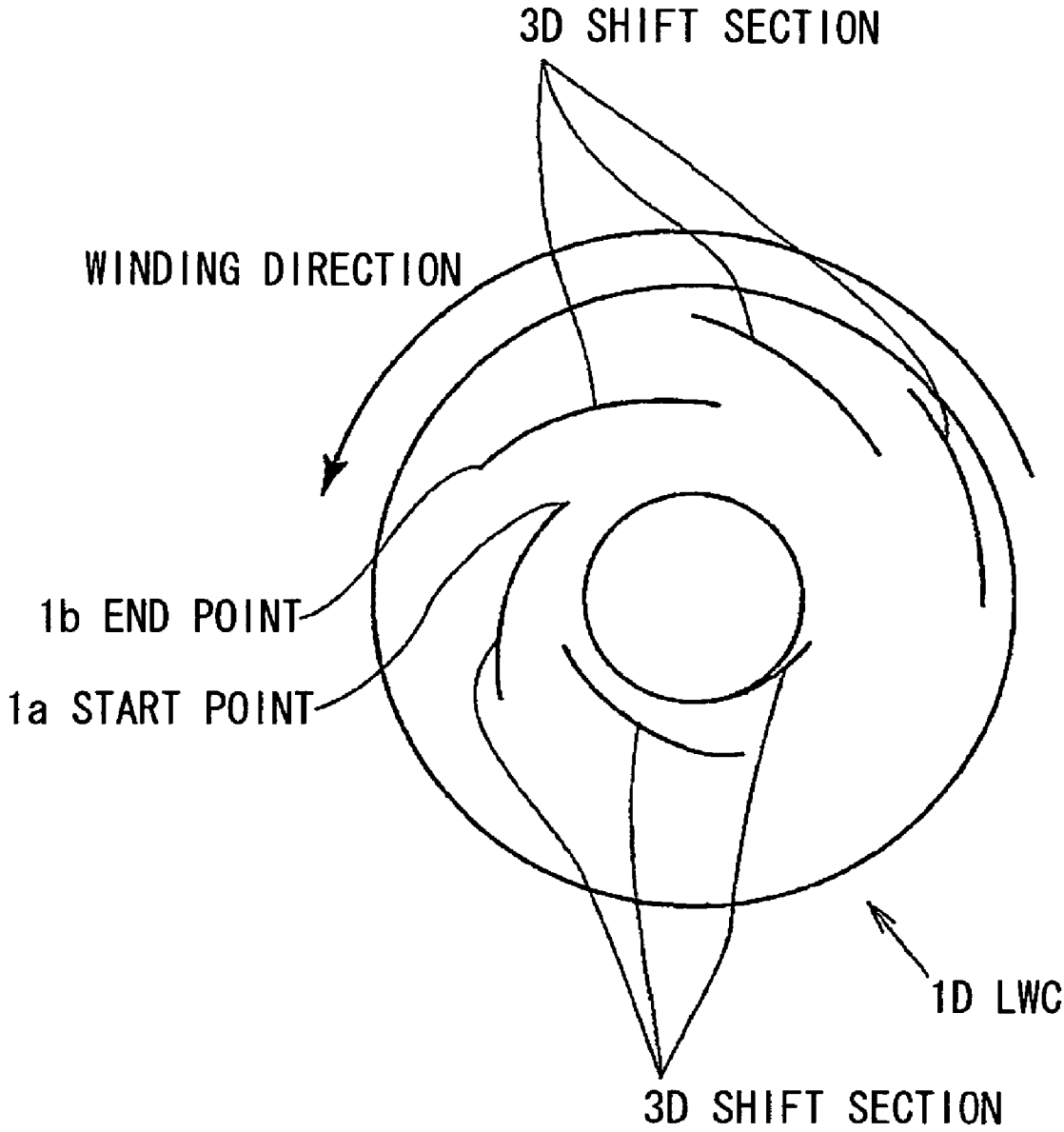
FIG. 4 is a schematic bottom view showing an LWC in a fourth preferred embodiment according to the invention.

FIG. 4 is a schematic bottom view showing an LWC in the fourth preferred embodiment according to the invention.

As shown, the LWC 1D is constructed such that a shift section 3D transits in sequence, spirally from the inner layer to the outer layer of the LWC, while having in the circumferential direction (however, in a forward direction to the winding direction of the coil) substantially a gap between the start point 1*a* of the k-th shift section (on inner-layer side) and end point 1*b* of the (k+1)-th shift section (on outer-layer side).

Figure 5:
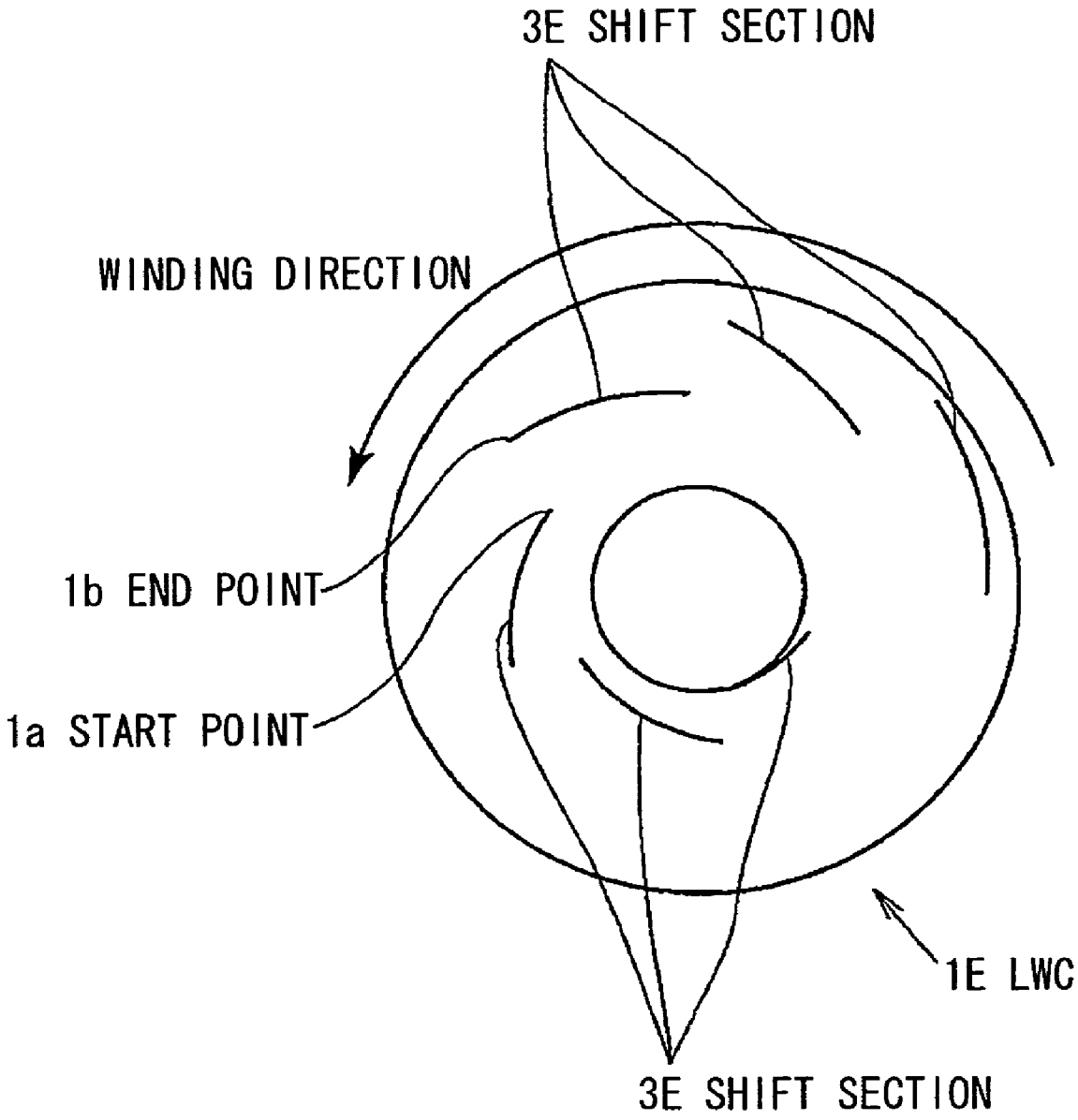
FIG. 5 is a schematic bottom view showing an LWC in a fifth preferred embodiment according to the invention.

FIG. 5 is a schematic bottom view showing an LWC in the fifth preferred embodiment according to the invention.

As shown, the LWC 1E is constructed such that a shift section 3E transits in sequence, spirally from the inner layer to the outer layer of the LWC, while having in the circumferential direction (however, in a reverse direction to the winding direction of the coil) substantially a gap between the start point 1*a* of the k-th shift section (on inner-layer side) and end point 1*b* of the (k+1)-th shift section. The gap is desirably 10 degrees or less in center angle (or sector angle) more desirably 5 degrees or less, and most desirably 3 degrees or less.

Figure 3:
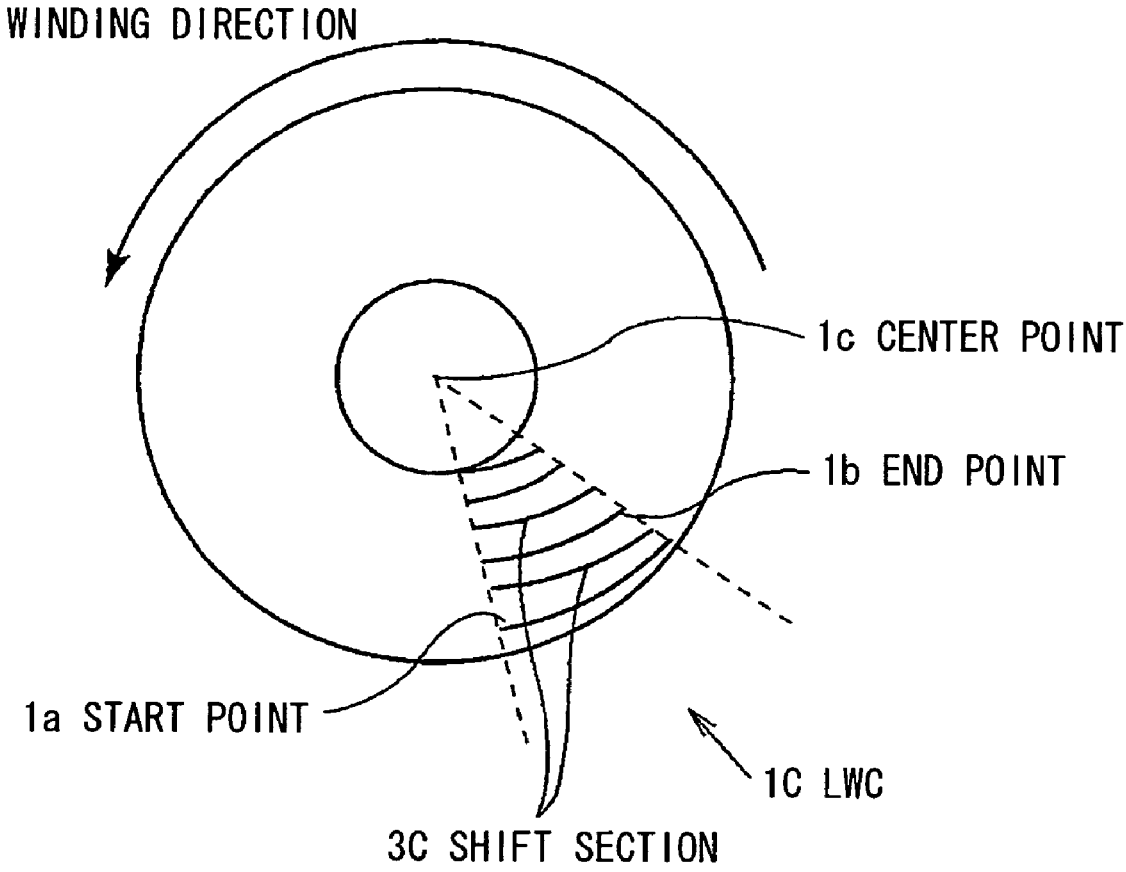
FIG. 3 is a schematic bottom view showing an LWC in a third preferred embodiment according to the invention.

On the other hand, FIG. 3 (=the third preferred embodiment according to the invention) is a schematic bottom view showing an example that the start point 1*a* of the (k+1)-th shift section (on outer-layer side) does not transit, in a forward or reverse direction to the winding direction of the copper pipe, relative to the start point 1*a* of the k-th shift section (on inner-layer side).

As shown, the LWC 1C is constructed such that the k-th shift section 3C (on inner-layer side) and the (k+1)-th shift section 3C (on outer-layer side) transit lying on a same radius on the bottom surface of the LWC 1C. Further, all the shift sections 3C are within a sector region that is formed connecting between a center point 1*c* on the bottom surface of the LWC 1C and the start point 1*a* and end point 1*b* of the outermost shift section 3C.

It is desired that the shift sections are deconcentrated in sequence spirally on the entire bottom surface of an LWC, as shown in FIGS. 1, 4 and 5, comparing with that the shift sections are concentrated on one half side of the entire bottom surface, as shown in FIGS. 2 and 3, since the pipe trapping phenomenon can be easily reduced at the shift section during the feeding of the copper pipe from the LWC.

Figure 6A:
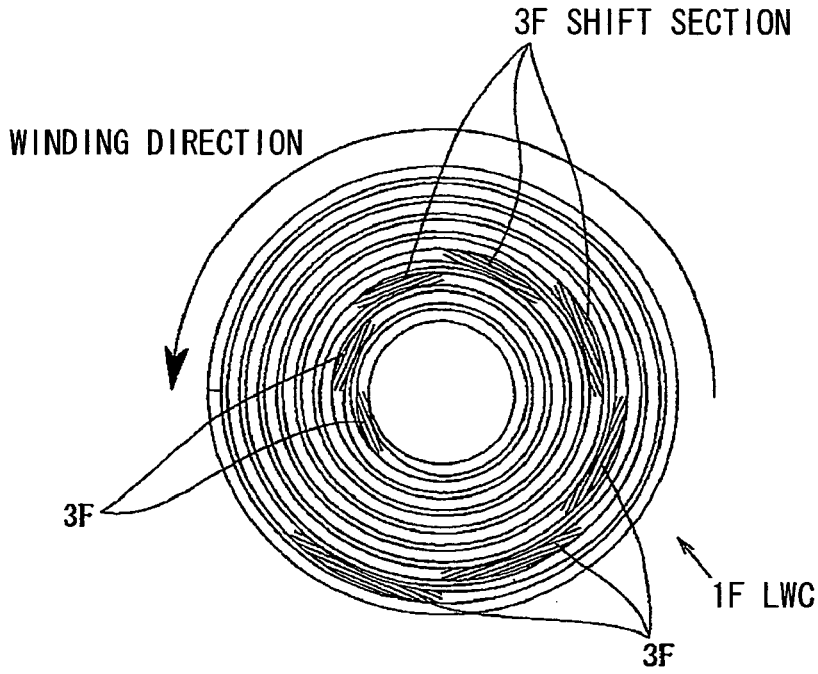
FIG. 6A is a schematic bottom view showing an example of an LWC according to the invention.
Figure 6B:
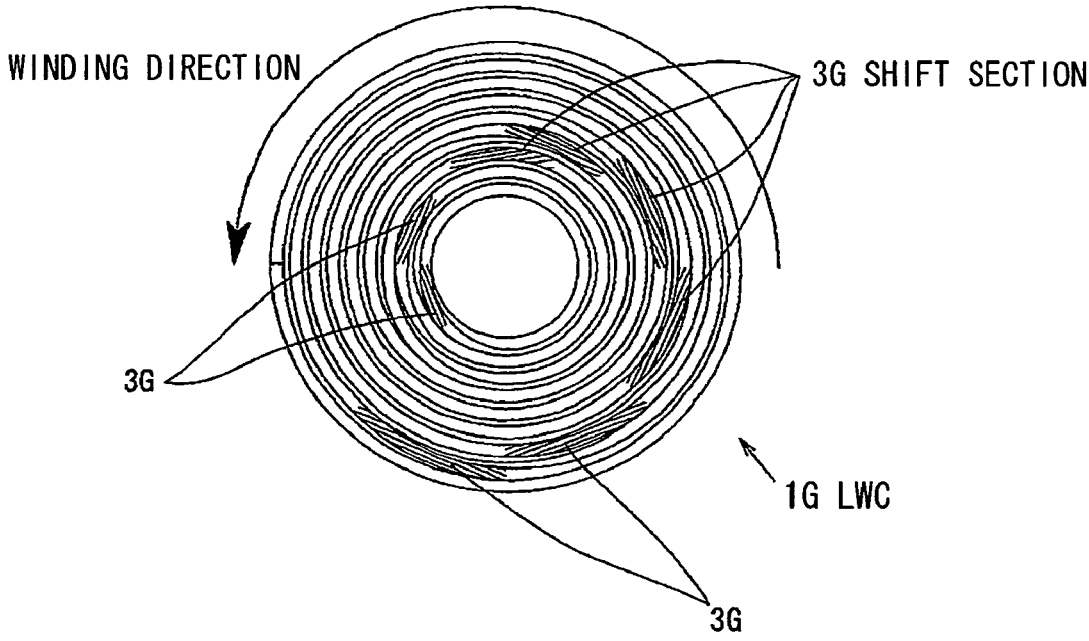
FIG. 6B is a schematic bottom view showing another example of an LWC according to the invention.
Figure 7A:
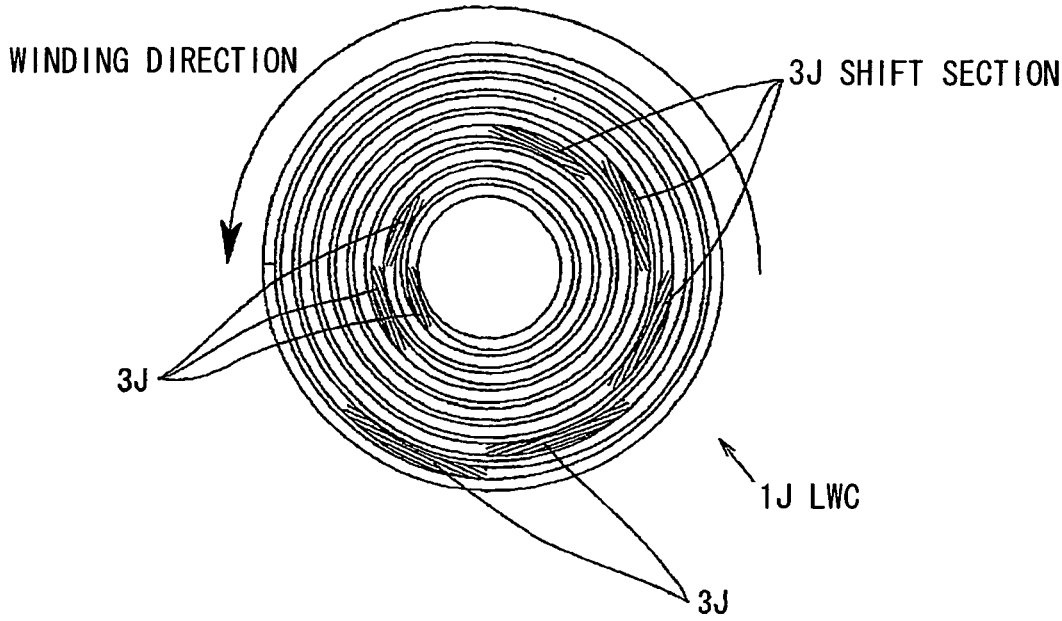
FIG. 7A is a schematic bottom view showing a comparative example of an LWC.
Figure 7B:
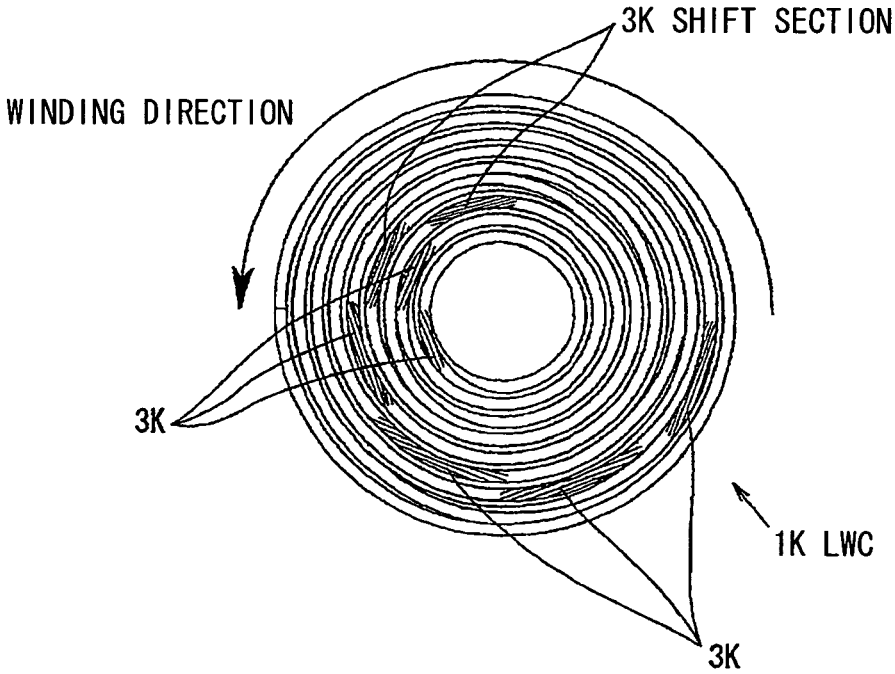
FIG. 7B is a schematic bottom view showing another comparative example of an LWC.

FIGS. 6A and 6B are schematic bottom views showing examples of an LWC according to the invention. FIGS. 7A and 7B are schematic bottom views showing comparative example LWC's.

As shown in FIG. 6A, the LWC 1F is constructed such that a shift section 3F transits in sequence spirally from the inner layer to the outer layer of the LWC, where the shift section 3F transits uniformly in a reverse direction (i.e., clockwise) to the winding direction (i.e., counterclockwise) of the copper pipe. Although the number of layers in FIG. 6A is different from that in FIG. 1, both are common in that the LWC has always the shift section at lower end in any vertical sections obtained when cutting vertically the LWC along the coil center axis.

As shown in FIG. 6B, the LWC 1G is common to that in FIG. 6A in that the shift section 3G transits in a reverse direction (i.e., clockwise) to the winding direction (i.e., counterclockwise) of the copper pipe, but different from the latter in that the third shift section from the coil center is shifted to the clockwise direction. In FIG. 6B, a part of the third shift section from the coil center exists on a same section as the fourth shift section. Thus, the LWC 1G does not have a shift section in a vertical section (including the coil center axis) which is cut radially from the coil center axis.

The invention can be applied in the embodiments as shown in FIGS. 6A and 6B. The vertical section without the shift section is preferably about one third or less (i.e., the sum of the central angle of sectors (on the coil bottom surface viewing from the coil center axis) without the shift section is 120 degrees or less) of all vertical sections, more preferably one fourth or less (i.e., the sum of the central angle is 90 degrees or less) of all vertical sections, most preferably one sixth (i.e., the sum of the central angle is 60 degrees or less) of all vertical sections.

On the other hand, as shown in FIG. 7A, the LWC 1J is constructed such that the third shift section 3J transits, relative to the second shift section 3J, in the same direction (i.e., clockwise) as the winding direction of the copper pipe. Namely, the third shift section exists on the same sector as the first shift section. Thus, the LWC 1J does not have a shift section in a vertical section (including the coil center axis) which is cut radially from the coil center axis.

Further, as shown in FIG. 7B, the LWC 1K is constructed such that the fourth or later shift section 3J transits in the same direction (i.e., counterclockwise) as the winding direction of the copper pipe.

In the LWC 1J wound as shown in FIG. 7A, when feeding the second shift section from the innermost layer, the second shift section is likely to be trapped since it is pressed against and sandwiched by the outer-layer pipe due to the existence of the third shift section to be uncoiled posterior to there.

In the LWC 1K wound as shown in FIG. 7B, when feeding the third or later shift section from the innermost layer, the third or later shift section is likely to be trapped since it its pressed against and sandwiched by the outer-layer pipe due to the existence of the fourth or higher later shift section to be uncoiled posterior to there.

In contrast, in the LWC's wound as shown in FIGS. 6A and 6B, the shift section can be easy fed without being pressed against and sandwiched by the outer-layer pipe.

Process of Forming the Shift Section

The process of forming the shift section will be described below.

FIGS. 8A to 8E are schematic perspective views showing a process of forming a shift section in an LWC.

Figure 8A:
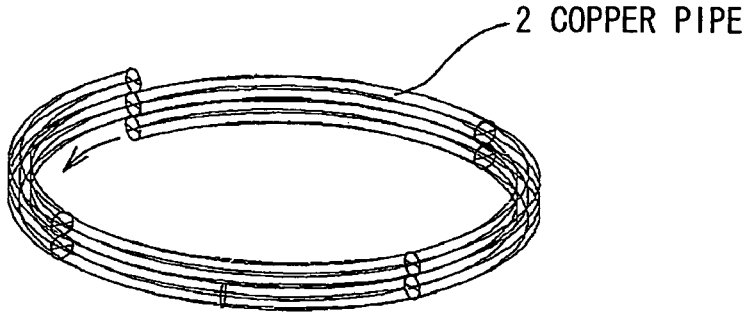
FIGS. 8A to 8E are schematic perspective views showing a process of forming a shift section in an LWC.
Figure 8B:
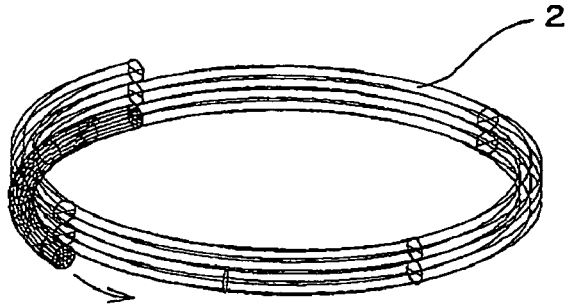
Figure 8C:
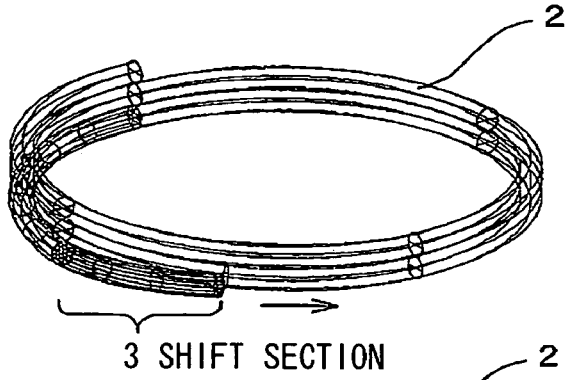
Figure 8D:
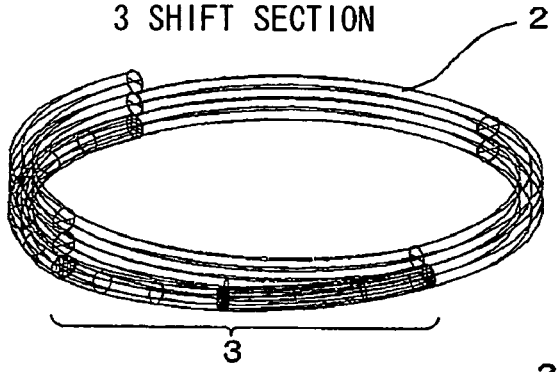
Figure 8E:
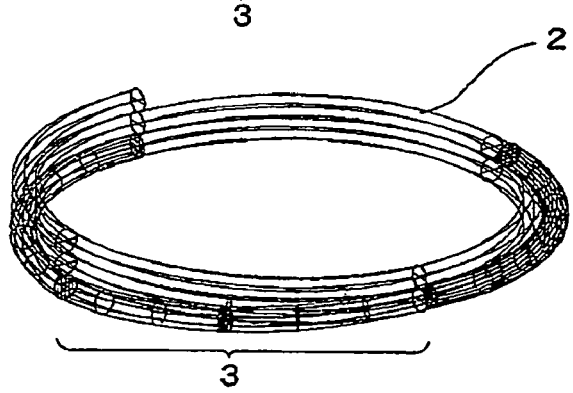

At the bottom side of each of FIGS. 8A to 8E, a copper pipe at lower end in a certain layer in the LWC is shown. When the copper pipe is wound up to the lower end (FIGS. 8A and 8B), a shift section 3 appears in shifting to the next layer (the outer layer) (FIG. 8C), and then the copper pipe is shifted to the next layer while further forming the shift section 3 (FIGS. 8D and 8E). In FIGS. 8A to 8E, for simplification in explanation, the pipe (coil) is shown helical-wound (=in spiral winding).

Relationship Between Pipe Winding Method and Configuration of Shift Section

Referring to FIGS. 9 to 14, the relationship between the pipe winding method and the configuration of shift section will be explained below. Although a start point of a shift section is shown in FIGS. 9 to 14, a real start point is located at just after the start point as shown.

Figure 9:
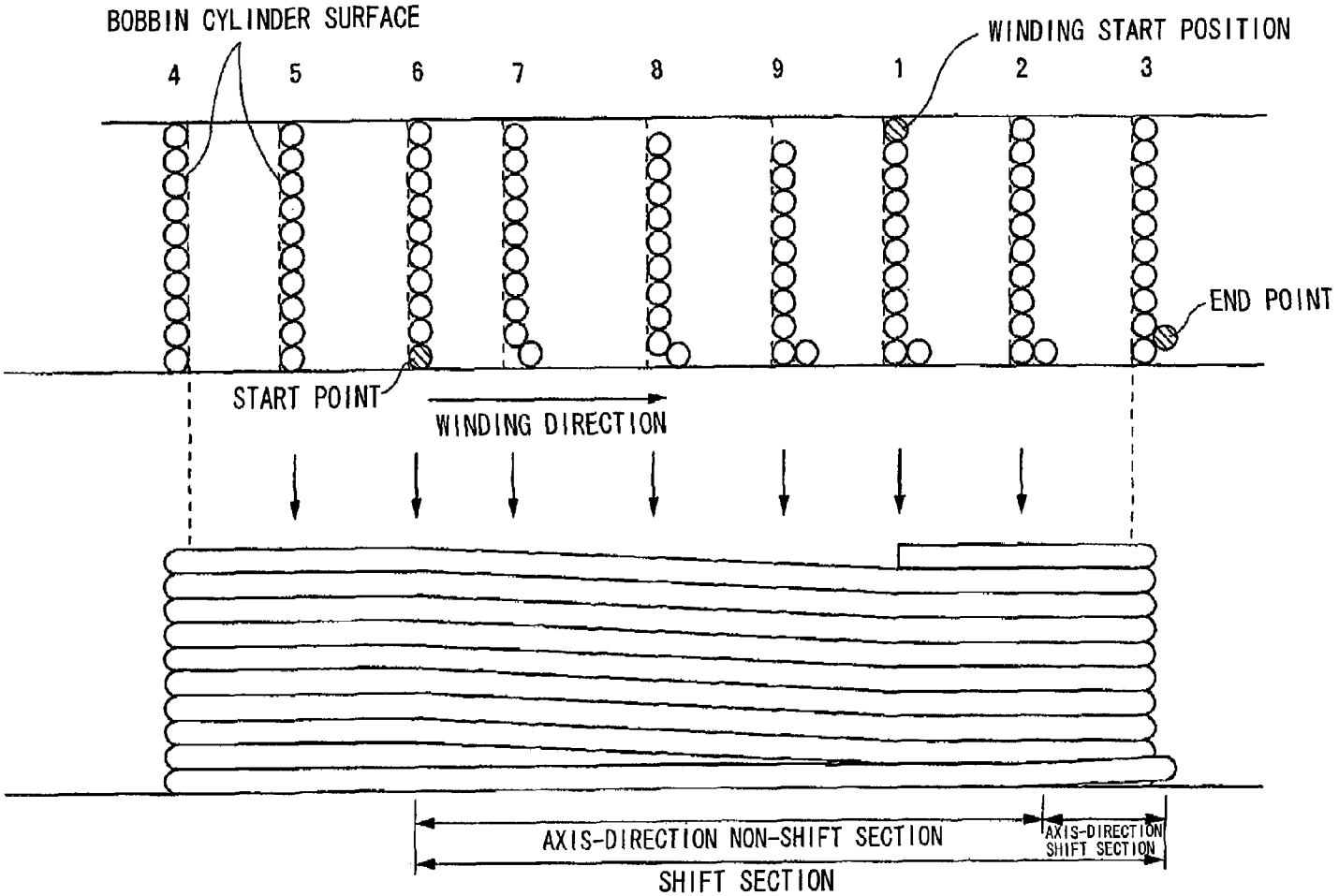
FIG. 9 is a schematic side view of LWC (below) and a schematic vertical cross sectional view of LWC (above) at each position (Nos. 1-9) as indicated by a downward arrow showing a shift section from a first layer to a second layer in a comparative-example winding method, where a start point of a (k+1)-th shift section (on outer-layer side) transits, in a forward direction to the winding direction of a copper pipe, relative to a start point of a k-th shift section (on inner-layer side)
Figure 10:
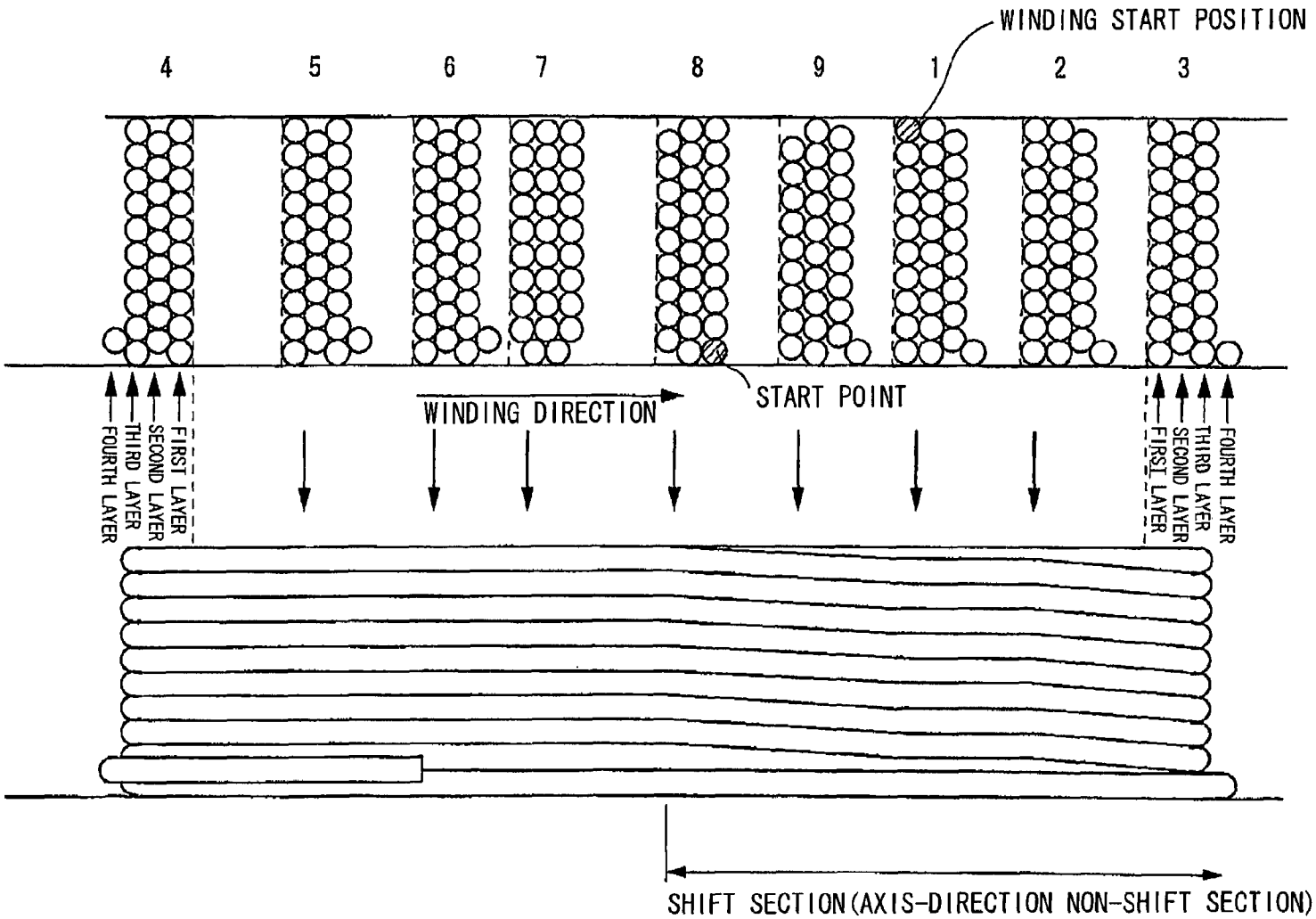
FIG. 10 is a schematic side view of LWC (below) and a schematic vertical cross sectional view of LWC (above) at each position (Nos. 1-9) as indicated by a downward arrow showing a shift section from a third layer to a fourth layer in the comparative-example winding method in FIG. 9.

FIGS. 9 and 10 show a comparative-example winding method, where a start point of a (k+1)-th shift section (on outer-layer side) transits, in a forward direction to the winding direction of a copper pipe, relative to a start point of a k-th shift section (on inner-layer side).

FIG. 9 is a schematic side view of LWC (below) and a schematic vertical cross sectional view of LWC (above) at each position (Nos. 1-9) as indicated by a downward arrow showing a shift section (and a transition region before and/or after there) from the first layer to the second layer. Meanwhile, the start point and end point of a shift section are also referred to as start position and end position with respect to FIGS. 9 to 14.

FIG. 10 is a schematic side view of LWC (below) and a schematic vertical cross sectional view of LWC (above) at each position (Nos. 1-9) as indicated by a downward arrow showing a shift section (and a transition region before and/or after there) from the third layer to the fourth layer.

It is found that, as compared to the position (i.e., from the start position 6 to the end position 3) of the shift section as shown in FIG. 9, the position (i.e., from the start position 8 to an end position located behind) of the shift section as shown in FIG. 10 is delayed more than one circuit. Further, it is found in FIGS. 9 and 10 that its axis-direction non-shift section (a section being sandwiched between a copper pipe and amount surface) is so long that the pipe is likely to be trapped.

Figure 11:
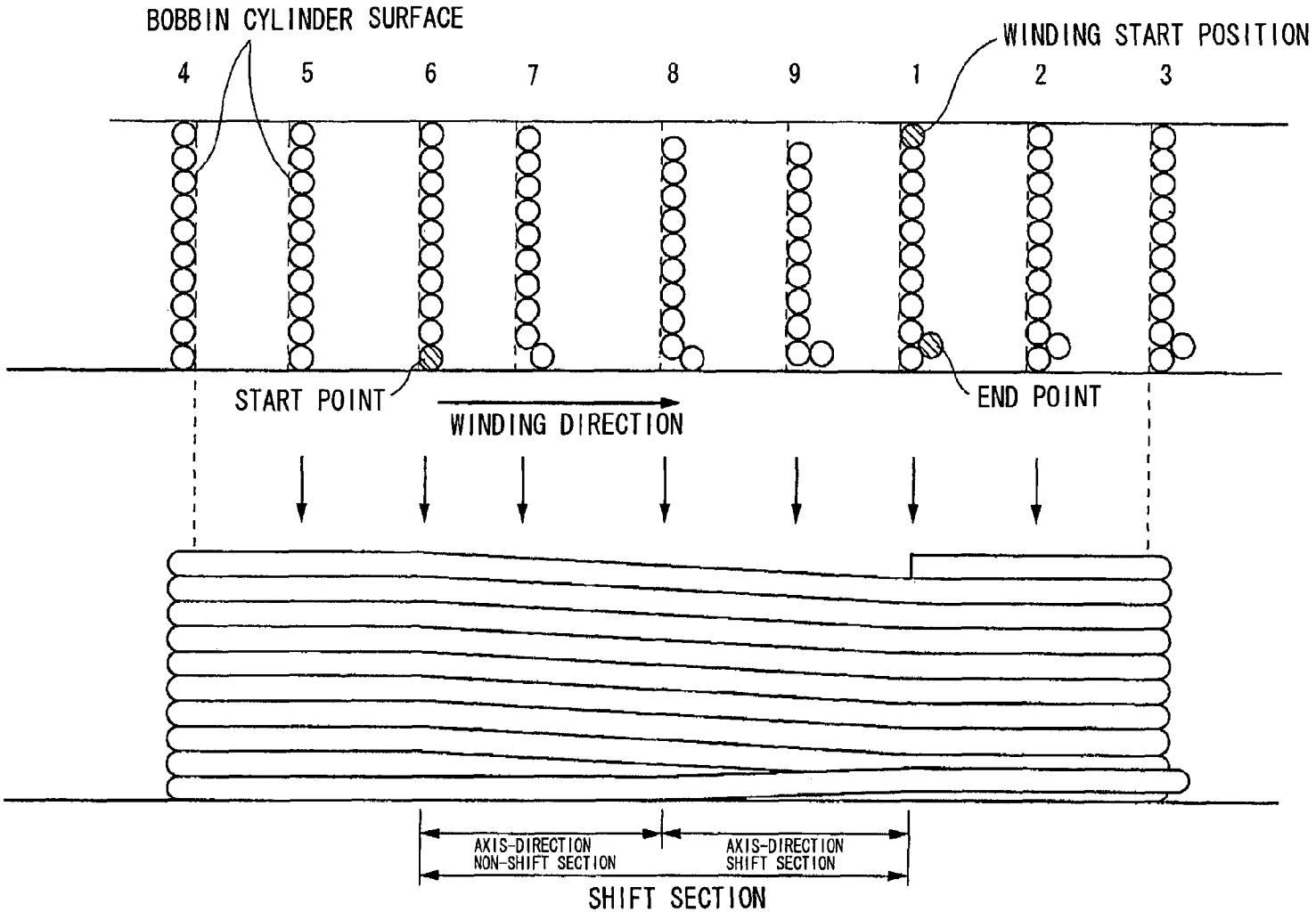
FIG. 11 is a schematic side view of LWC (below) and a schematic vertical cross sectional view of LWC (above) at each position (Nos. 1-9) as indicated by a downward arrow showing a shift section from a first layer to a second layer in an example winding method, where a start point of a (k+1)-th shift section (on outer-layer side) does not transit, in a forward or reverse direction to the winding direction of a copper pipe, relative to a start point of a k-th shift section (on inner-layer side)
Figure 12:
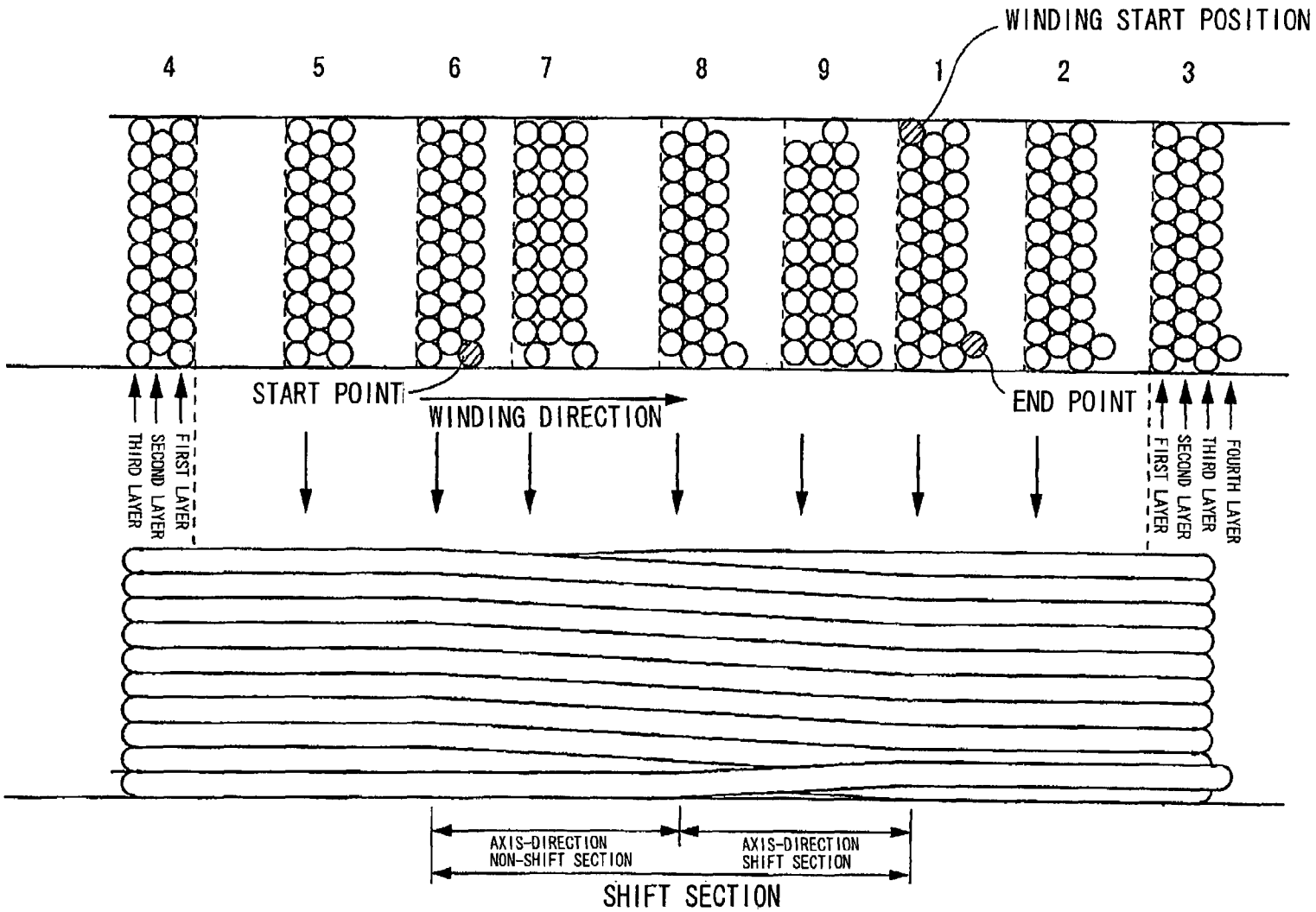
FIG. 12 is a schematic side view of LWC (below) and a schematic vertical cross sectional view of LWC (above) at each position (Nos. 1-9) as indicated by a downward arrow showing a shift section from a third layer to a fourth layer in the example winding method in FIG. 11.

FIGS. 11 and 12 show an example winding method, where a start point of a (k+1)-th shift section (on outer-layer side) does not transit, in a forward or reverse direction to the winding direction of a copper pipe, relative to a start point of a k-th shift section (on inner-layer side). The LWC as shown in FIG. 3 can be formed by this method.

FIG. 11 is a schematic side view of LWC (below) and a schematic vertical cross, sectional view of LWC (above) at each position (Nos. 1-9) as indicated by a downward arrow showing a shift section (and a transition region before and/or after there) from the first layer to the second layer.

FIG. 12 is a schematic side view of LWC (below) and a schematic vertical cross sectional view of LWC (above) at each position (Nos. 1-9) as indicated by a downward arrow showing a shift section (and a transition region before and/or after there) from the third layer to the fourth layer.

It is found that the position (i.e., from the start position 6 to the end position 1) of the shift section as shown in FIG. 11 is located at substantially the same position as the position (i.e., from the start position 6 to the end position 1) of the shift section as shown in FIG. 12. Further, it is found in FIGS. 11 and 12 that its axis-direction non-shift section (a section being sandwiched between a copper pipe and a mount surface) of the shift section is shorter than that in FIGS. 9 and 10 so that the pipe is less likely to be trapped.

Figure 13:
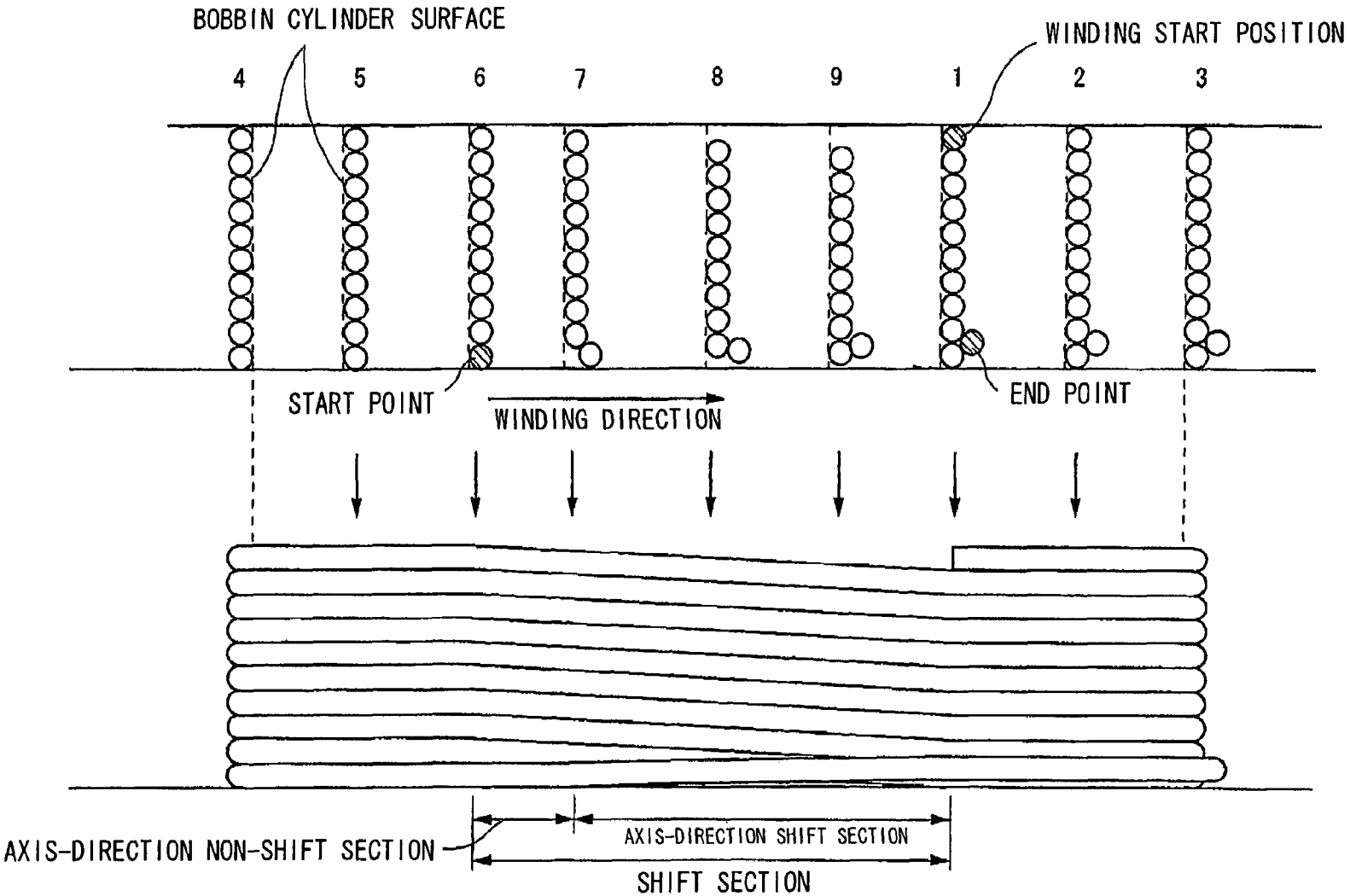
FIG. 13 is a schematic side view of LWC (below) and a schematic vertical cross sectional view of LWC (above) at each position (Nos. 1-9) as indicated by a downward arrow showing a shift section from a first layer to a second layer in an example winding method, where a start point of a (k+1)-th shift section (on outer-layer side) transits, in a reverse direction to the winding direction of a copper pipe, relative to a start point of a k-th shift section (on inner-layer side)
Figure 14:
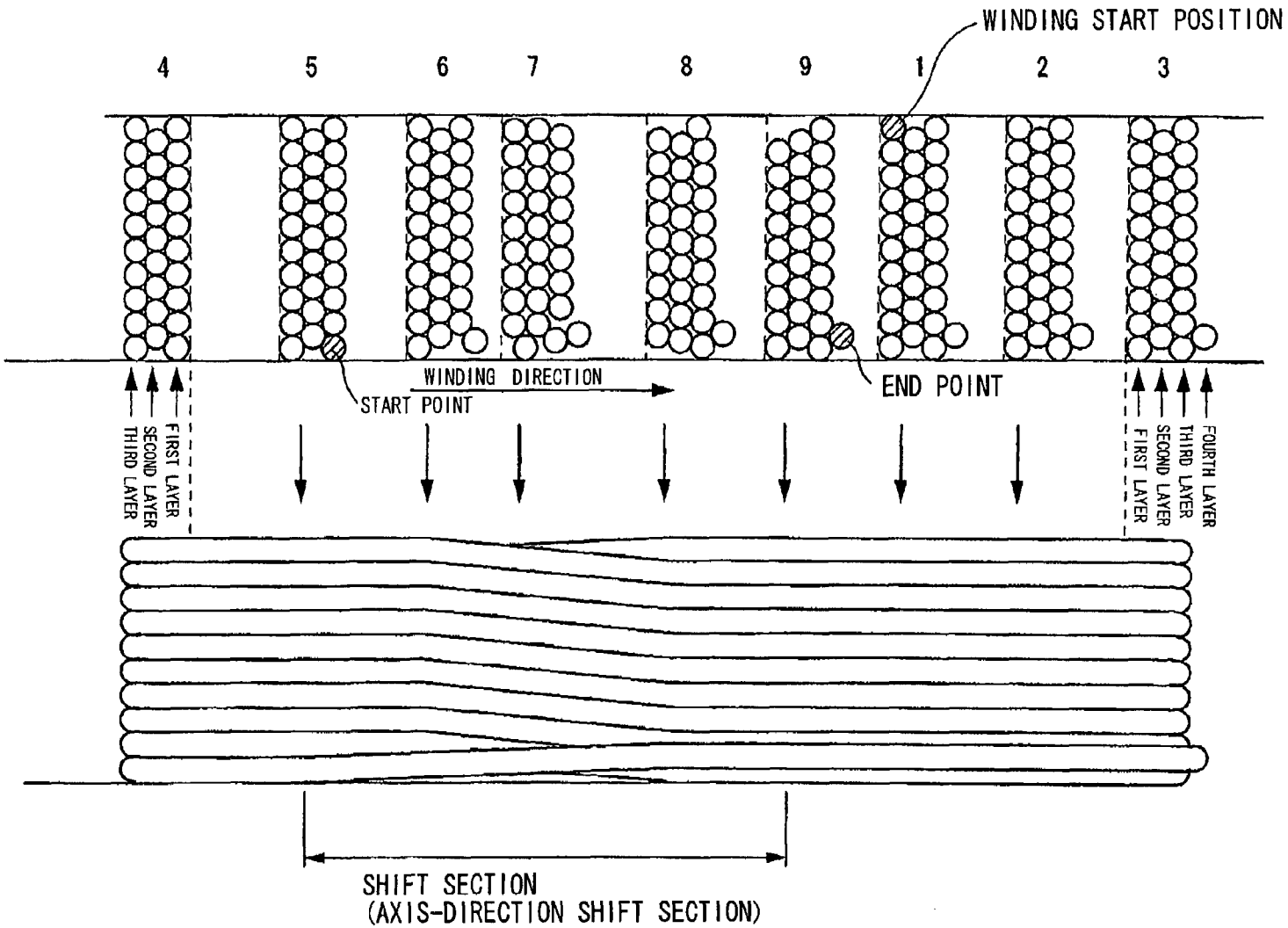
FIG. 14 is a schematic side view of LWC (below) and a schematic vertical cross sectional view of LWC (above) at each position (Nos. 1-9) as indicated by a downward arrow showing a shift section from a third layer to a fourth layer in the example winding method in FIG. 13.

FIGS. 13 and 14 show an example winding method, where a start point of a (k+1)-th shift section (on outer-layer side) transits, in a reverse direction to the winding direction of a copper pipe, relative to a start point of a k-th shift section (on inner-layer side).

FIG. 13 is a schematic side view of LWC (below) and a schematic vertical cross sectional view of LWC (above) at each position (Nos. 1-9) as indicated by a downward arrow showing a shift section (and a transition region before and/or after there) from the first layer to the second layer.

FIG. 14 is a schematic side view of LWC (below) and a schematic vertical cross sectional view of LWC (above) at each position (Nos. 1-9) as indicated by a downward arrow showing a shift section (and a transition region before and/or after there) from the third layer to the fourth layer.

It is found that, as compared to the position (i.e., from the start position 6 to the end position 1) of the shift section as shown in FIG. 13, the position (i.e., from the start position 5 to the end position 9) of the shift section as shown in FIG. 14 is advanced one circuit. Further, it is found in FIGS. 13 and 14 that its axis-direction non-shift section (a section being sandwiched between a copper pipe and a mount surface) is so short (nearly disappeared) that the pipe is less likely to be trapped.

Figure 15:
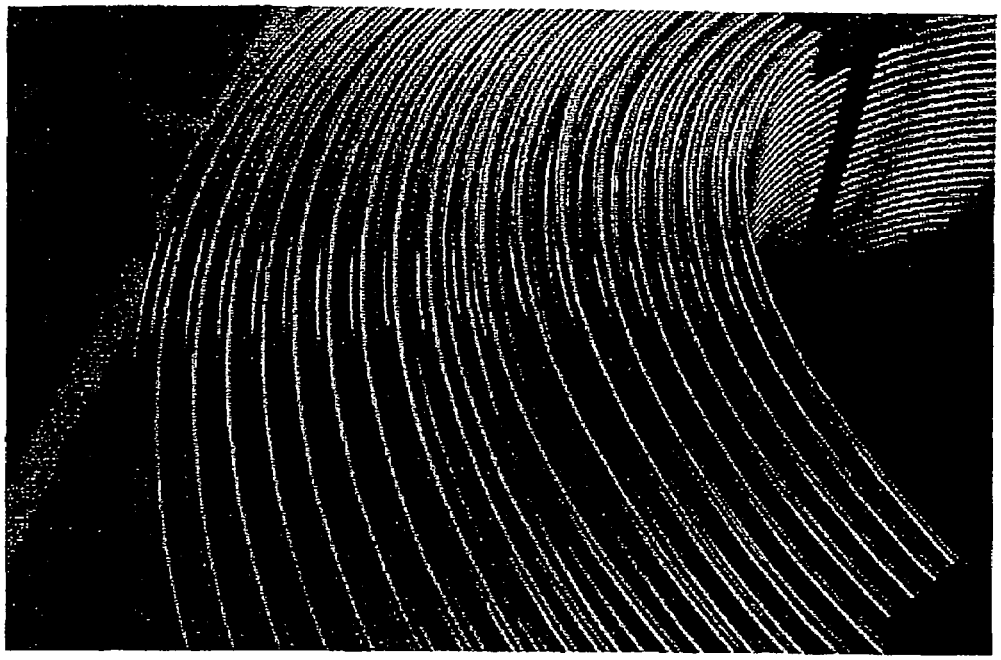
FIG. 15 is a photograph showing a part of a shift section on the bottom surface of an LWC.

FIG. 15 is a photograph showing a part of a shift section on the bottom surface of an LWC. It is found in FIG. 15 that the pipe winding of about the eighth to ninth layers from the innermost layer is different from that of the other layers.

Method of Manufacturing the LWC According to the Invention

LWC's according to the invention can be made by the conventional method. For example, the method as disclosed in JP-A-2002-370869 (e.g., paragraph [0039] is available. However, the invention's method is different from the conventional method in that it is conducted to adjust (or control) the location of a shift section formed at the lower end of LWC by changing the shift start position in shifting from an m-th layer (on inner-layer side) to an (m+1)-th layer (on outer-layer side).

The method of adjusting (or controlling) the location is not specifically limited. For example, in winding the copper pipe around the bobbin, the shift section can be adjusted by shifting the copper pipe on the m-th layer (on inner-layer side) to the (m+1)-th layer before it forms a circuit in winding at a return portion of the traverse winding to form the lower end of LWC, in order that the shift section transits in a reverse direction to the winding direction and in sequence spirally from the inner layer to the outer layer of the coil.

The location of the shift section as shown in FIGS. 1, 2, 4 and 5 can be obtained by winding such that a start point of a (k−1)-th shift section (on outer-layer side) is located at a vertical section in the reverse direction to the winding direction (located on the same side when viewing from the coil center axis) including the coil center axis where a start point of a k-th shift section (on inner-layer side) is located.

The location of the shift section as shown in FIG. 3 can be obtained by winding such that the start points of both the (k+1)-th shift section (on outer-layer side) and the k-th shift section (on inner-layer side) are located on the same vertical section (located on the same side when viewing from the coil center axis) including the coil center axis, and the end points of both the (k+1)-th shift section (on outer-layer side) and the k-th shift section (on inner-layer side) are located on the same vertical section (located on the same side when viewing from the coil center axis, and different from that including the start point) including the coil center axis.

Figure 16A:
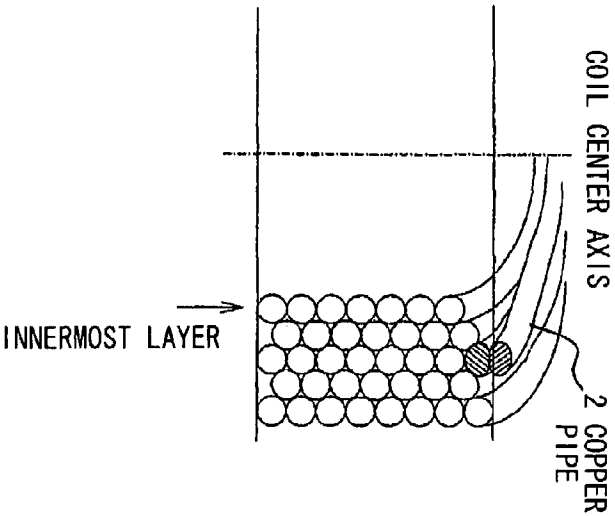
FIG. 16A is a schematic cross sectional view showing an LWC in a comparative example.
Figure 16B:
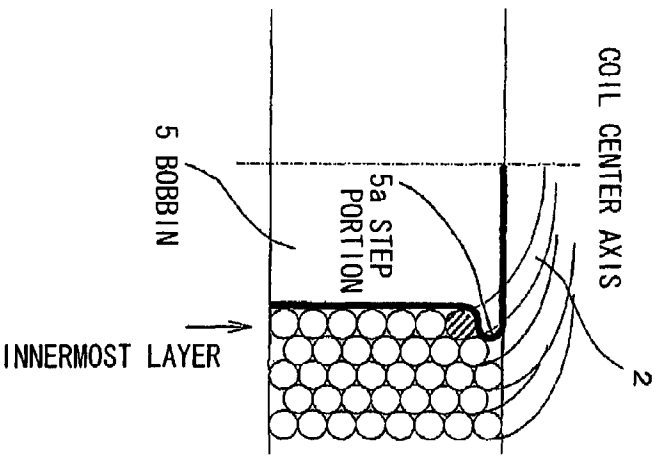
FIG. 16B is a schematic cross sectional view showing an LWC in an embodiment of the invention.
Figure 17A:
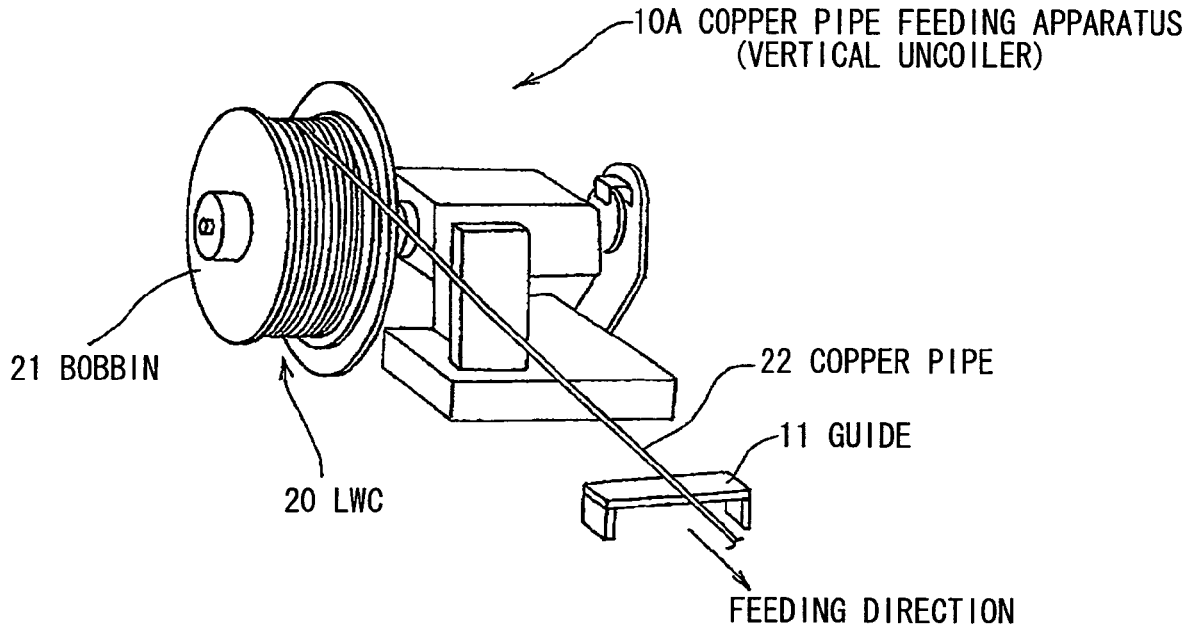
FIG. 17A PRIOR ART
FIG. 17A is a perspective view showing the conventional copper pipe feeding apparatus (vertical uncoiler)
Figure 17B:
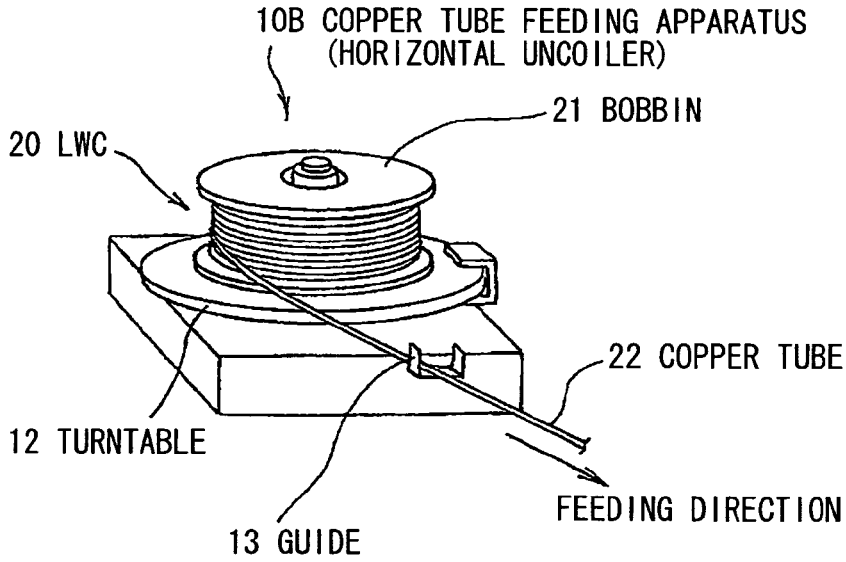
FIG. 17B PRIOR ART
FIG. 17B is a perspective view showing the conventional copper pipe feeding apparatus (horizontal uncoiler)
Figure 18:
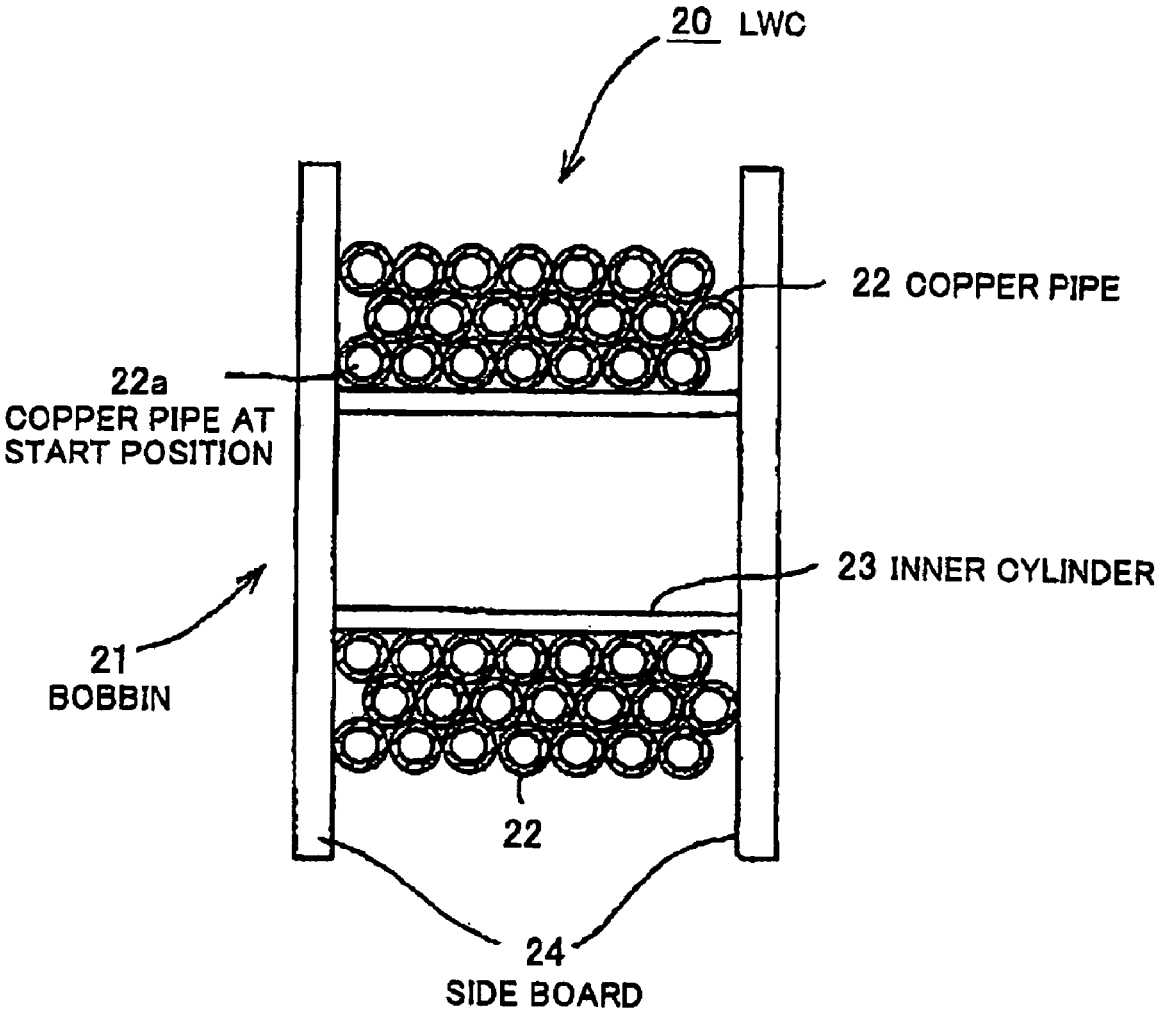
FIG. 18 PRIOR ART
FIG. 18 is a schematic cross sectional view showing a detailed arrangement of LWC coiled around a bobbin in FIG. 17A or 17B.
Figure 19:
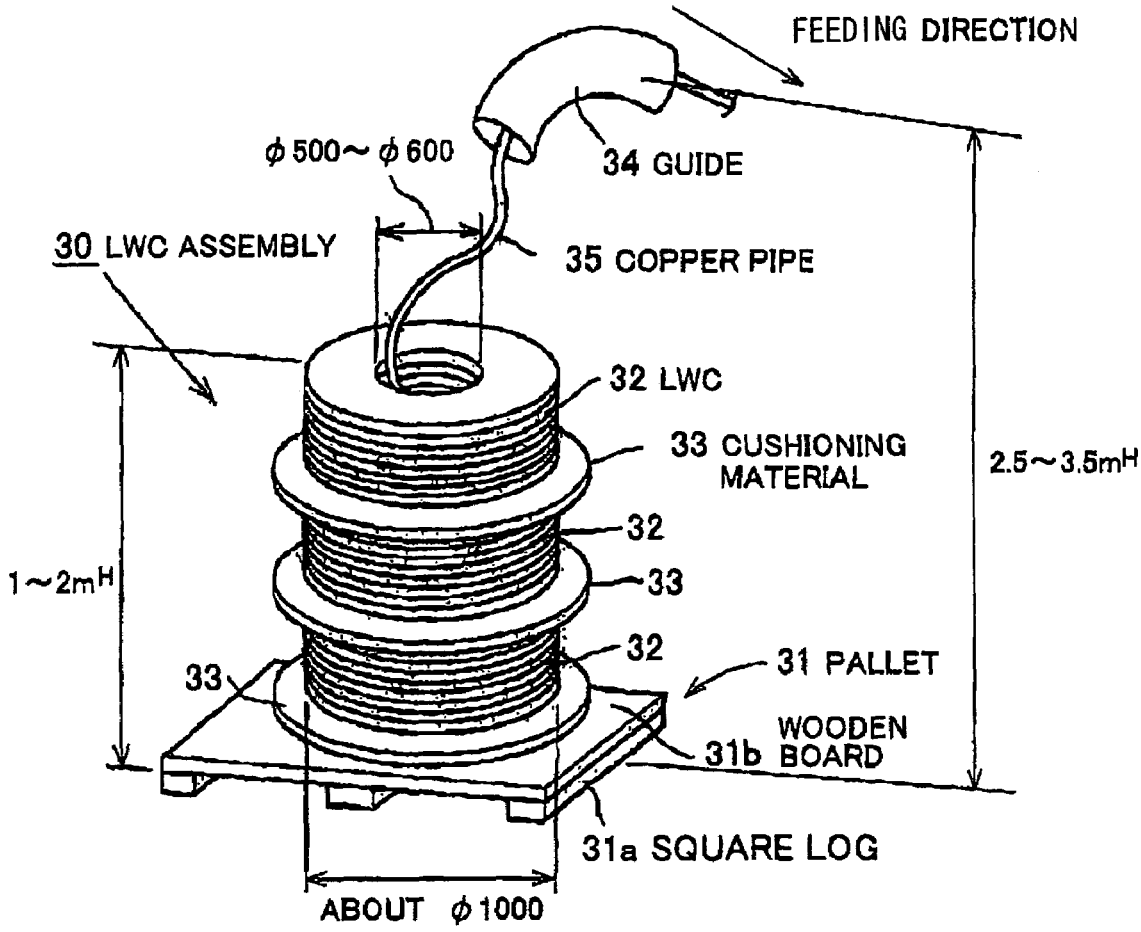
FIG. 19 PRIOR ART
FIG. 19 is a perspective view showing a method of feeding a copper pipe by the ETTS method.
Figure 20:
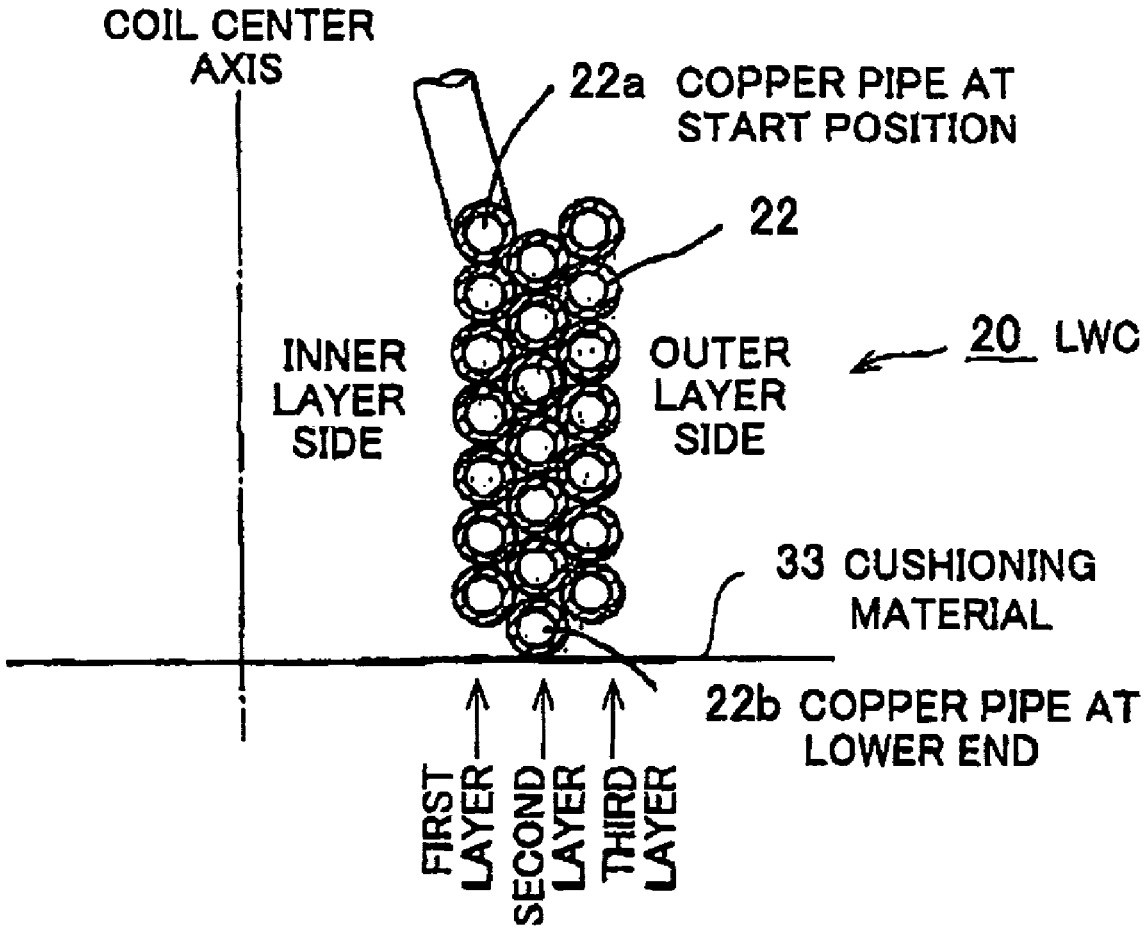
FIG. 20 PRIOR ART
FIG. 20 is a schematic cross sectional view illustrating an uncoiling method in LWC.

FIG. 16A is a schematic cross sectional view showing an LWC in a comparative example, and FIG. 16B is a schematic cross sectional view showing an LWC in an embodiment of the invention.

FIG. 16A shows a situation (in the comparative example) that an end portion of an innermost-layer copper pipe 2 is shifted on or protruded from the coil end surface to deform a pipe of the other layer when plural LWC's are stacked with the innermost-layer copper pipe wound up to the coil end surface. FIG. 16B shows a structure that can solve this problem, where the innermost layer is (n−i) in winding number where i=0 and the winding number of the second layer from the innermost layer is n, by providing a step portion 5*a* with one end of the bobbin 5 in winding the copper pipe (or in producing the LWC) in order that the end portion of the innermost layer is not shifted on or protruded from the coil end surface even after the bobbin 5 is removed. The winding number (n−i) of the innermost layer is not always limited to i=0 and may be suitably changed according to a degree of spring-back phenomenon (i.e., a phenomenon of the pipe end portion protruding from the coil end surface) of a copper pipe. The value i is preferably a positive integer of i=0 to 2. Namely, provided that the innermost layer is the first layer of an LWC and that the winding number of the second layer and an even-numbered layer thereafter is n, it is desired that the first layer is n or less, i.e., n, n−1 and n−2, in winding number.

Composition of an LWC Package

The package of the invention has a composition similar to that disclosed in JP-A-2002-370869. However, it is different from the conventional package in that the shift section is located according to the invention on the bottom surface of LWC. Therefore, the package can reduce the pipe trapping phenomenon at the shift section.

Method of Manufacturing the Package

The LWC package of the invention can be made by the conventional method, where the LWC package comprises a bag or case to house the whole LWC, and a strip resin film to fasten the side face of the LWC. For example, it can be made by using the method disclosed in JP-A-2002-370869. However, it is different from the conventional package in that the LWC of the invention is used.

EXAMPLE 1

An example of the invention will be described below.

Figure 21:
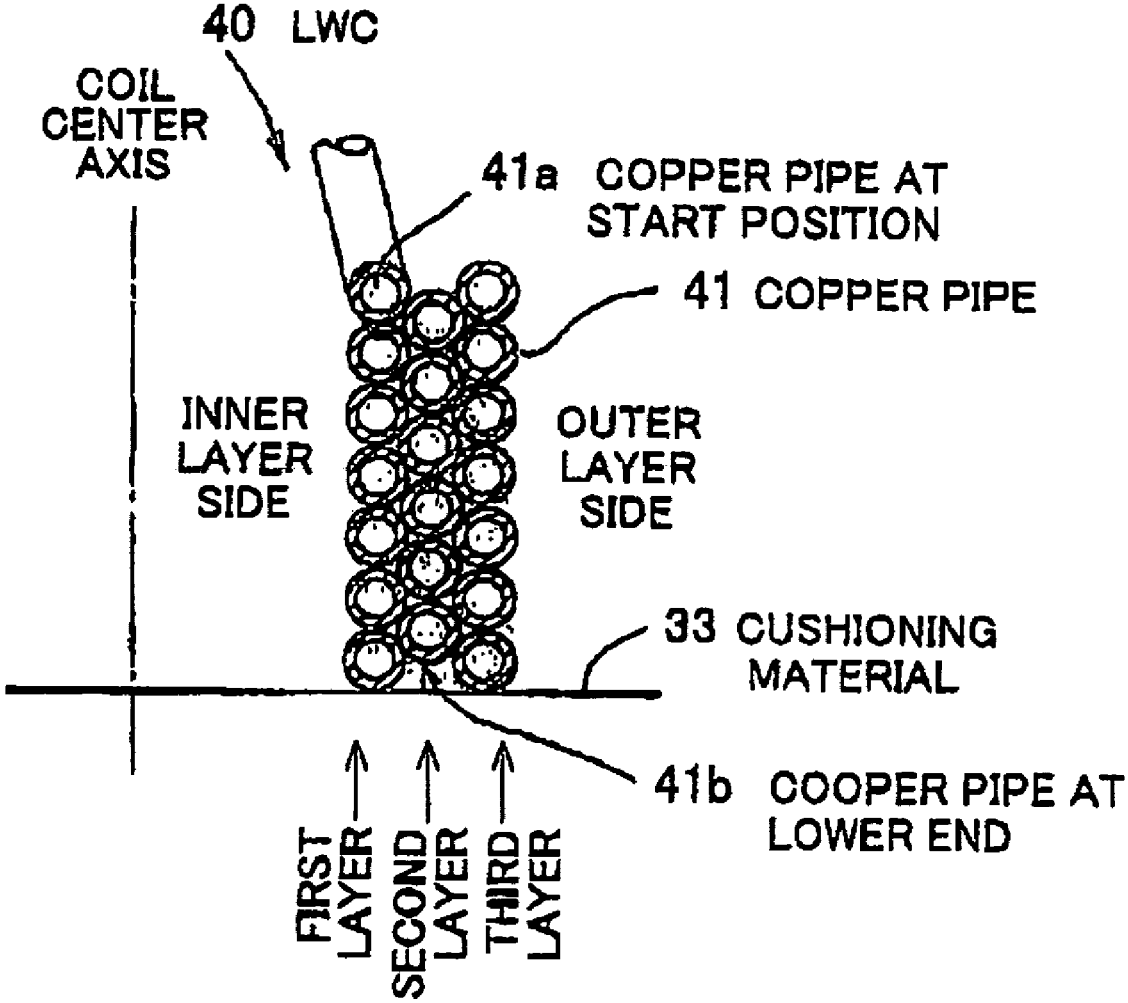
FIG. 21 PRIOR ART
FIG. 21 is a schematic cross sectional view illustrating an uncoiling method to facilitate the feeding of a copper pipe at lower end.
Figure 22:
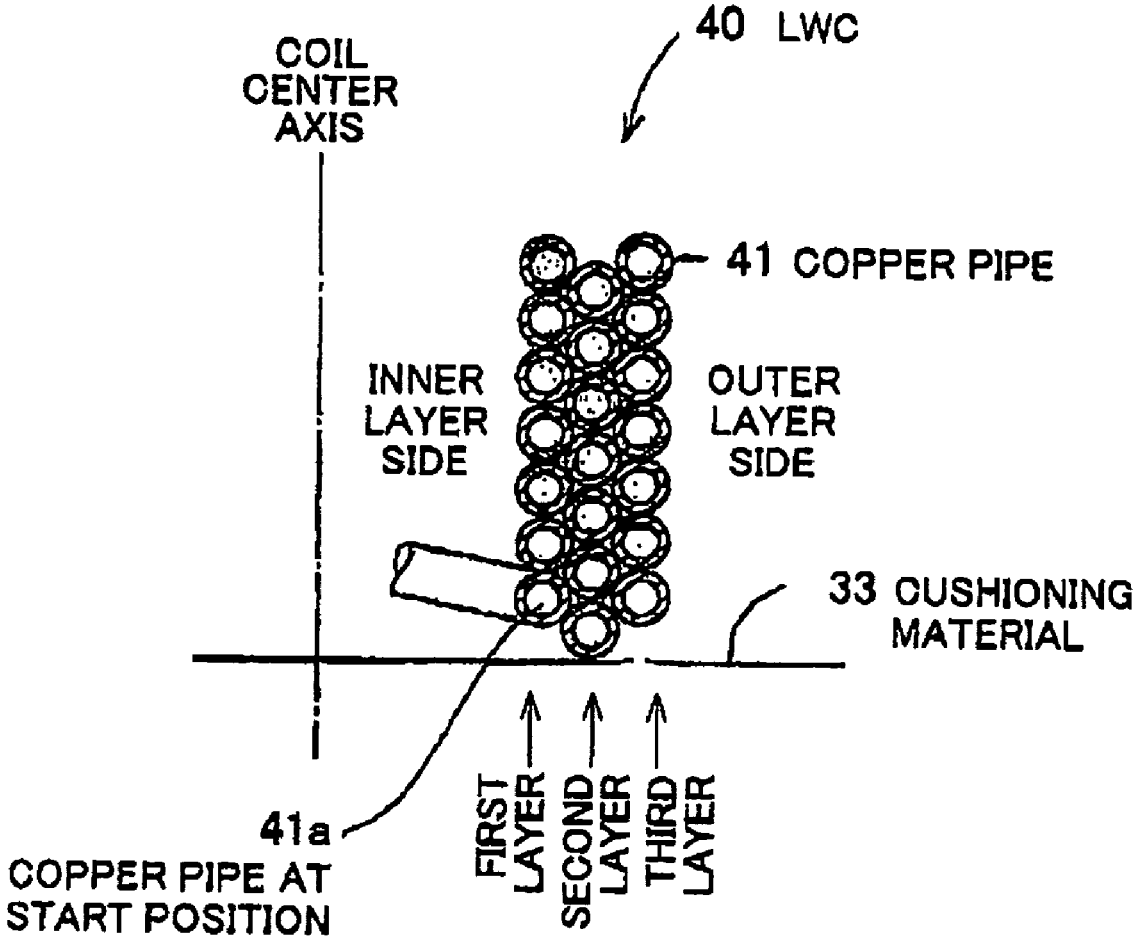
FIG. 22 PRIOR ART
FIG. 22 is a schematic cross sectional view illustrating another uncoiling method to facilitate the feeding of a copper pipe at lower end.
Figure 23B:
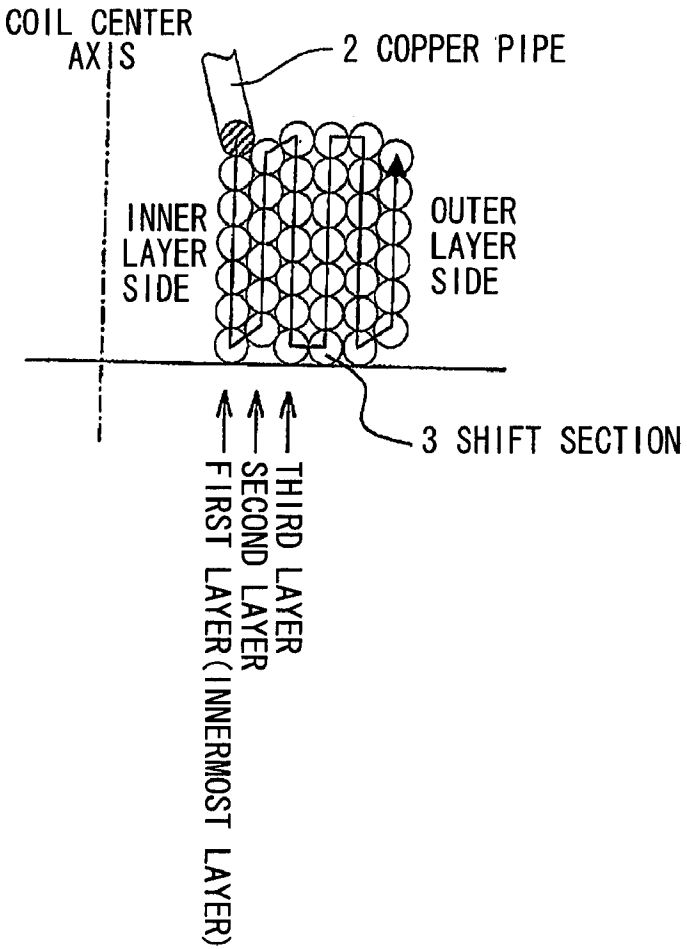
FIG. 23B PRIOR ART
FIG. 23B is a schematic cross sectional view illustrating a portion with a shift section in LWC.
Figure 23A:
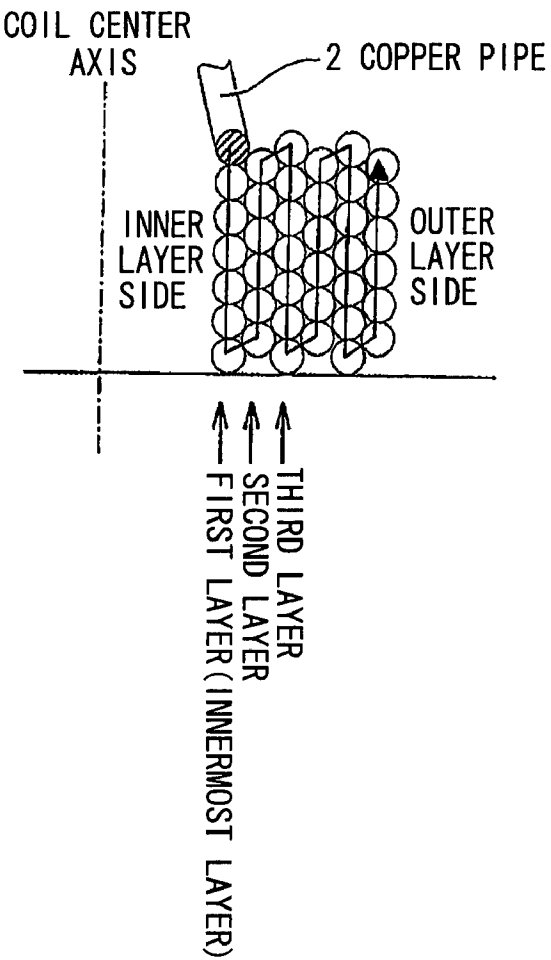
FIG. 23A PRIOR ART
FIG. 23A is a schematic cross sectional view illustrating a portion without a shift section in LWC.

The LWC (Example 1) of the above embodiment is made and is evaluated in feeding easiness (number of pipe trapping). The LWC is wound by the winding method as shown in FIG. 21, and the location of a shift section is as shown in FIG. 1 or 4. In the evaluation, the weight of each LWC is in a range of 160-250 kg and 20 coils are tested. Herein, the pipe trapping means that the feeding of a pipe is stuck or stopped because the supply of the pipe is blocked by some reason.

The copper pipe is 7 mm in outer diameter, 0.25 mm in average wall thickness, and an inner grooved pipe of phosphorus deoxidized copper (hereinafter simply called copper pipe).

For comparison, the LWC of Comparative example 1 is wound by the winding method as shown in FIG. 21, and the location of a shift section is as shown in FIG. 7A or 7B, where the LWC is, at the bottom surface, provided with the shift section with a reversed transition direction (i.e., the transition direction of the shift section at the bottom surface is locally the same as the winding direction of the copper pipe). Also in the evaluation of Comparative example 1, the weight of each LWC is in a range of 160-250 kg and 20 coils are tested.

The evaluation results are as shown in Table 1. In Table 1, the cumulative incidence number of pipe trapping in feeding the copper pipe is shown.

TABLE 1

<Feeding easiness (number of pipe trapping)>

| | Comparative Example 1 | Example 1 |
|---|---|---|
| LWC (20 coils each) | >Wound as shown in FIG. 21, >the location of shift section formed as shown in FIG. 7A or 7B | >Wound as shown in FIG. 21, >the location of shift section formed as shown in FIG. 1 or 4 |
| Cumulative incidence number of pipe trapping (failed coils/20 coils) | 47 (19/20) | 0 (0/20) |

As shown in Table 1, Comparative Example 1 has a pipe trapping in 19 coils of the 20 coils and in total 47 trappings of the pipe at the lower end of the LWC during the feeding. It is assumed that the occurrence of pipe trapping phenomenon in this case depends on the degree of reversal in transition direction of the shift section (i.e., the amount of transition in the same direction as the winding direction of the copper pipe, and/or the number of shift sections transiting to the same direction as the winding direction of the copper pipe). In the event, the pipe trapping happens in most of the coils.

In contrast, Example 1 has no trapping. In general, when a trapping happens during the feeding of copper pipe, a cutter has to be stopped to remove the trapping and then to be restarted. However, in the invention, since no trapping happens, the operation can be conducted efficiently.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A level wound coil (LWC), comprising:

a plurality of coil layers, each of which comprises a pipe wound in alignment winding and in traverse winding, wherein a coil of a (m+1)-th coil layer is located such that a pipe at a start position thereof is fitted into a concave part formed outside of the m-th coil layer and between a pipe at a lower end of the m-th coil layer and an adjacent pipe of the m-th coil layer, wherein, when the LWC is disposed on a mount surface perpendicular to a coil center axis of the LWC, m is an odd natural number if a start position of the winding of the LWC is located at an upper end of the coil and m is an even natural number if the start position of the winding is located at a lower end of the coil, wherein the LWC comprises a shift section such that the pipe is shifted from the m-th coil layer to the (m+1)-th coil layer on a bottom surface thereof when the LWC is disposed on the mount surface, and wherein the shift section comprises a k-th shift section on an inner layer and a (k+1)-th shift section on an outer layer side, wherein a start point of the (k+1)-th shift section transits, relative to a start point of the k-th shift section, in a direction other than a winding direction of the pipe.

2. The LWC according to claim 1, wherein:

the (k+1)-th shift section transits, relative to the start point of the k-th shift section in a direction reverse to the winding direction of the pipe.

3. The LWC according to claim 1, wherein:

the shift section spirally transits in sequence from an inner coil layer to an outer coil layer of the LWC such that, in a circumferential direction of the LWC, substantially no gap occurs between the start point of the k-th shift section and an end point of the (k+1)-th shift section.

* * * * *